United States Patent [19]

Harrell

[11] Patent Number: 4,651,896

[45] Date of Patent: Mar. 24, 1987

[54] SINGLE ARTICLE VENDING MACHINE

[75] Inventor: Bob G. Harrell, Carrolton, Miss.

[73] Assignee: News Vend 1, Inc., Greenwood, Miss.

[21] Appl. No.: 642,416

[22] Filed: Aug. 20, 1984

[51] Int. Cl.[4] ..... G07F 11/14

[52] U.S. Cl. ..... 221/229; 221/232; 221/241

[58] Field of Search ..... 221/227, 228, 229, 232, 221/240, 241, 242, 249, 213–216

[56] References Cited

U.S. PATENT DOCUMENTS

| | | | |
|---|---|---|---|
| 2,195,305 | 3/1940 | Heaton | 221/213 X |
| 2,972,400 | 2/1961 | Gabrielsen | 194/19 |
| 2,991,867 | 7/1961 | Schuller | 194/18 |
| 3,709,405 | 1/1973 | Harris | 221/232 X |
| 3,738,466 | 6/1973 | Knickerbocker | 194/18 |
| 3,747,733 | 7/1973 | Knickerbocker | 194/10 |
| 3,882,984 | 5/1975 | Knickerbocker | 194/94 |
| 3,921,779 | 11/1975 | Pearson | 194/1 |
| 4,067,477 | 1/1978 | Chalabian | 221/1 |
| 4,183,426 | 1/1980 | Chalabian | 194/67 |
| 4,227,604 | 10/1980 | Chalabian | 194/102 |
| 4,273,256 | 6/1981 | Wenner | 221/241 X |
| 4,331,261 | 5/1982 | Brown | 221/232 |
| 4,418,836 | 12/1983 | Christian | 221/37 |
| 4,569,461 | 2/1986 | Orr | 221/227 X |

*Primary Examiner*—F. J. Bartuska

*Attorney, Agent, or Firm*—Alexander, Unikel, Bloom, Zalewa & Tenenbaum, Ltd.

[57] ABSTRACT

A machine for permitting access to and manual removal of one uppermost article from a stack of vertically positioned articles, such as a newspaper, upon deposit of a predetermined amount of payment in the form of coins and the like, including a manually movable vending mechanism actuated by a machine door that allows access to an article closure having an article access opening that is normally closed by a barrier member which is self-adjusting to the thickness of the article to be vended and which by a pawl and ratchet mechanism is withdrawn from access blocking position upon actuation of the vending mechanism by the machine door. The machine may include a coin receiver and totalizer that permits access through the movable door to the article to be vended through the article access opening.

21 Claims, 43 Drawing Figures

N1
N2
N3
N4
15
15

FIG-41
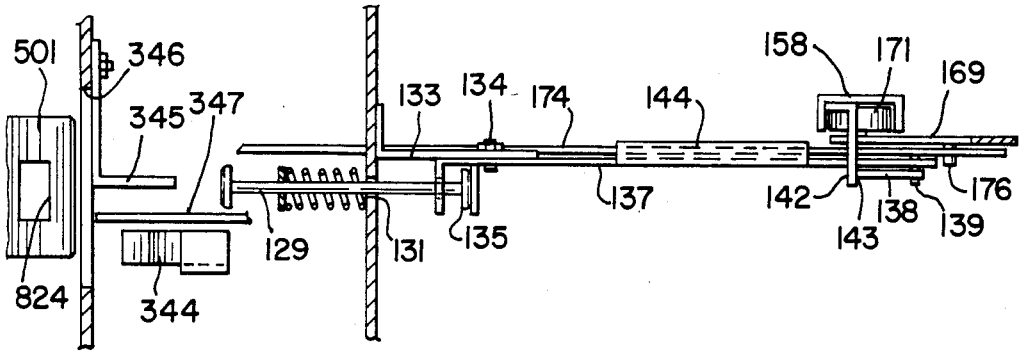
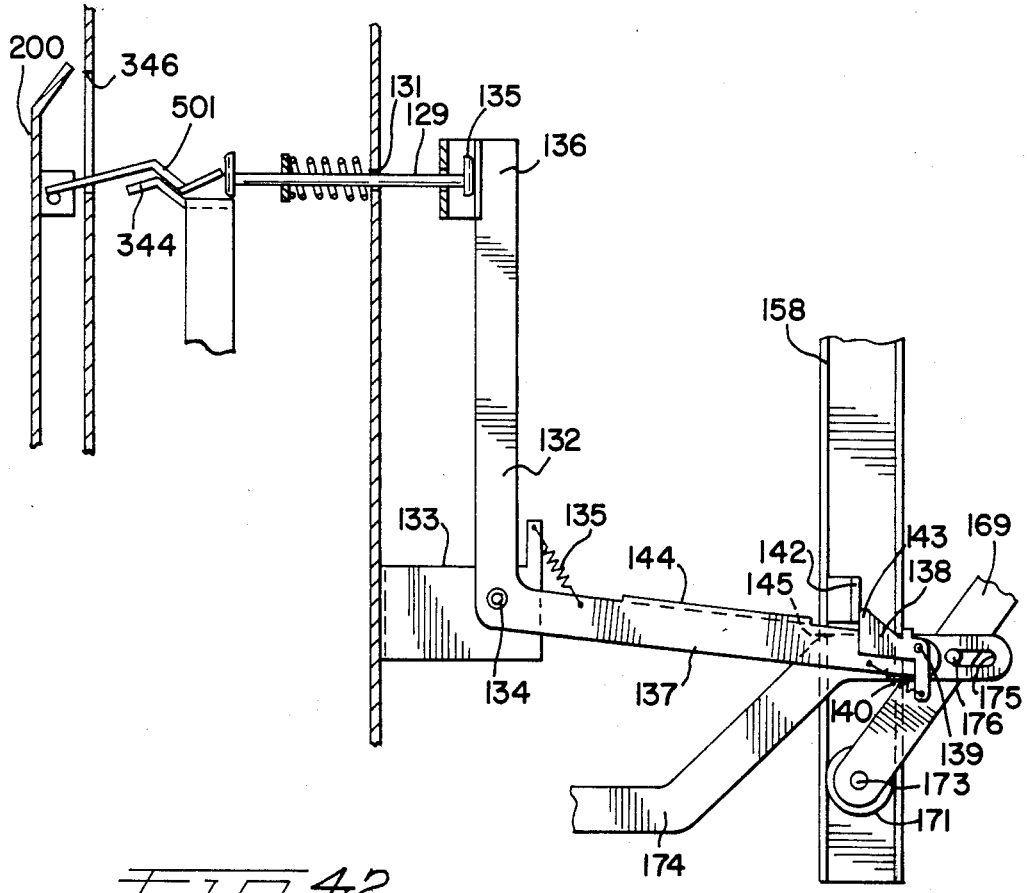
FIG-42

SINGLE ARTICLE VENDING MACHINE

RELATED APPLICATION

The invention described in this disclosure is an improvement over the machine disclosed in my co-pending U.S. patent application Ser. No. 512,455 filed July 1, 1984, now U.S. Pat. No. 4,527,711, and assigned to the assignee of this invention.

FIELD OF THE INVENTION

This invention relates to manually operated, coin deposit initiated machines which dispense one article, such as a newspaper, during each vend cycle.

DESCRIPTION OF THE PRIOR ART

Extensive past efforts to conceive and develop a one-at-a-time newspaper vending machine economically and functionally suitable for being adopted and widely used commercially have not been successful.

Minimum criteria or specifications which such machines are considered to be required to meet to be commercially acceptable are: dependability of operation without need of frequent maintenance or repair; ease of unloading or removing outdated unsold newspapers from the machine and placing current newspapers in the machine; a flexible or readily changed coin accepting mechanism to enable sale of, for example, a twenty-five-cent daily paper or a two-or-three-dollar Sunday paper; ability to dispense a single copy of a relatively thin, such as a one-half-inch thick, daily newspaper and to dispense a single copy of a relatively thick, such as a three-inch thick, Sunday newspaper, with little or preferably, no manual adjustment or subjective judgment required by an attendant; and the machine should require no external energy source, such as an electric outlet, but should be manually operable with little effort by the coin depositing customer.

Additionally, the machine should protect its contents against moisture, vandalism, and the ingenuity of customers desiring to obtain a plurality of newspapers for the price of one. Also, the newspaper should not be defaced or have portions rendered unreadable due to the vend cycle.

The prior art machines have failed to satisfy one or more of the above-listed criteria. They have often been mechanically complicated, operationally unreliable, difficult to maintain, difficult to load and unload, inadequately flexible in the ability to dispense articles of different thicknesses, and so costly to obtain and maintain that investment in them was uneconomic. Consequently, despite the large number of issued U.S. patents disclosing such machines, no single copy, coin deposit controlled, manually operated newspaper vending machine has been nor is now known to be in widespread commercial use nationally in the United States.

SUMMARY OF THE INVENTION

A coin deposit initiated, manually operated single copy newspaper, or similar article, vending machine has a dispensing mechanism which does not deface the paper. An access slot barrier member is self-adjusting to the thickness of each paper pushed into a dispensing slot by the dispensing mechanism. An upwardly biased paper support platform coacts with the vertically movable dispensing slot to maintain the top paper aligned with the dispensing slot. The machine is operated manually by a customer opening an operator door. Opening of the operator and access door serves both to cause a paper to be inserted partially through the dispensing slot or opening where it may be grasped by the customer and provides the customer access to the dispensing opening. The operator door is unlatched by placement of a predetermined coin deposit in the machine.

An improved coin totalizer mechanism and a novel coin sorter for sorting coins deposited in the coin mechanism are disclosed herein, together with a variety of other novel features, such as an improved last paper dispensing mechanism and a novel daily-Sunday price setting mechanism.

BRIEF DESCRIPTION OF THE DRAWINGS

FIG. 41 is a partial top sectional view of the machine showing an anti-cheat structure;

FIG. 42 is a side elevation view of the anti-cheat structure shown in FIG. 41.

DETAILED DESCRIPTION OF THE PREFERRED EMBODIMENT

Figure 1:
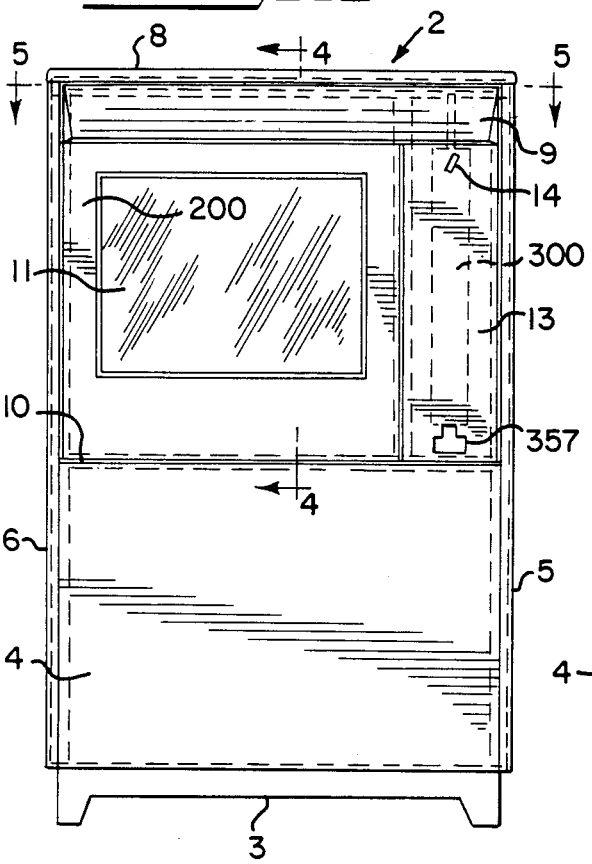
FIG. 1 is a front elevation view of the exterior of the vending machine of this invention.
Figure 2:
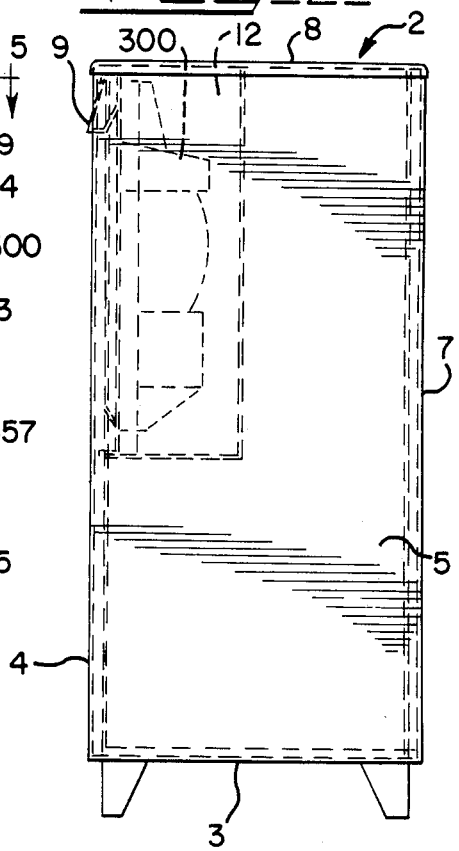
FIG. 2 is a right side elevation view of the machine shown in FIG. 1.
Figure 3:
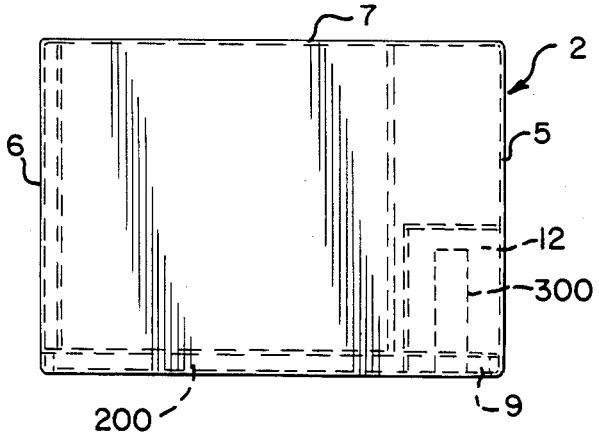
FIG. 3 is a top view of the machine shown in FIG. 1.

FIG. 1 is a front elevation view of a machine 2 of this invention and FIGS. 2 and 3 are, respectively, a right side elevation view and a top view of the machine 2 shown in FIG. 1.

Machine 2 is comprised of an article enclosing means or cabinet having a bottom closure and support base 3, a front enclosing wall 4, two side enclosing walls 5 and 6, a back enclosing wall 7 and a top cover 8.

At the upper frontal portion of the machine above front enclosing wall 4 an operating and access door assembly 200 is provided. Door assembly 200 has a manually graspable handle portion 9 and is hinged to front enclosing wall 4 to enable the door to be pivotally opened and closed by a hinge 10. Door assembly 200 is provided with a transparent display enclosure, such as glass enclosure 11.

A coin mechanism compartment or box 12 is provided within the enclosure cabinet formed by the enclosing walls 5 and 6 and the top and bottom members 8 and 3. A separate coin compartment access door 13 is provided to allow selective access to compartment 12 and a coin deposit opening or slot 14 is provided, preferably slanted, as shown, in door 13 to enable a customer to insert coins through the slot 14 into a coin mechanism assembly 300 normally contained within compartment 12.

Figure 4:
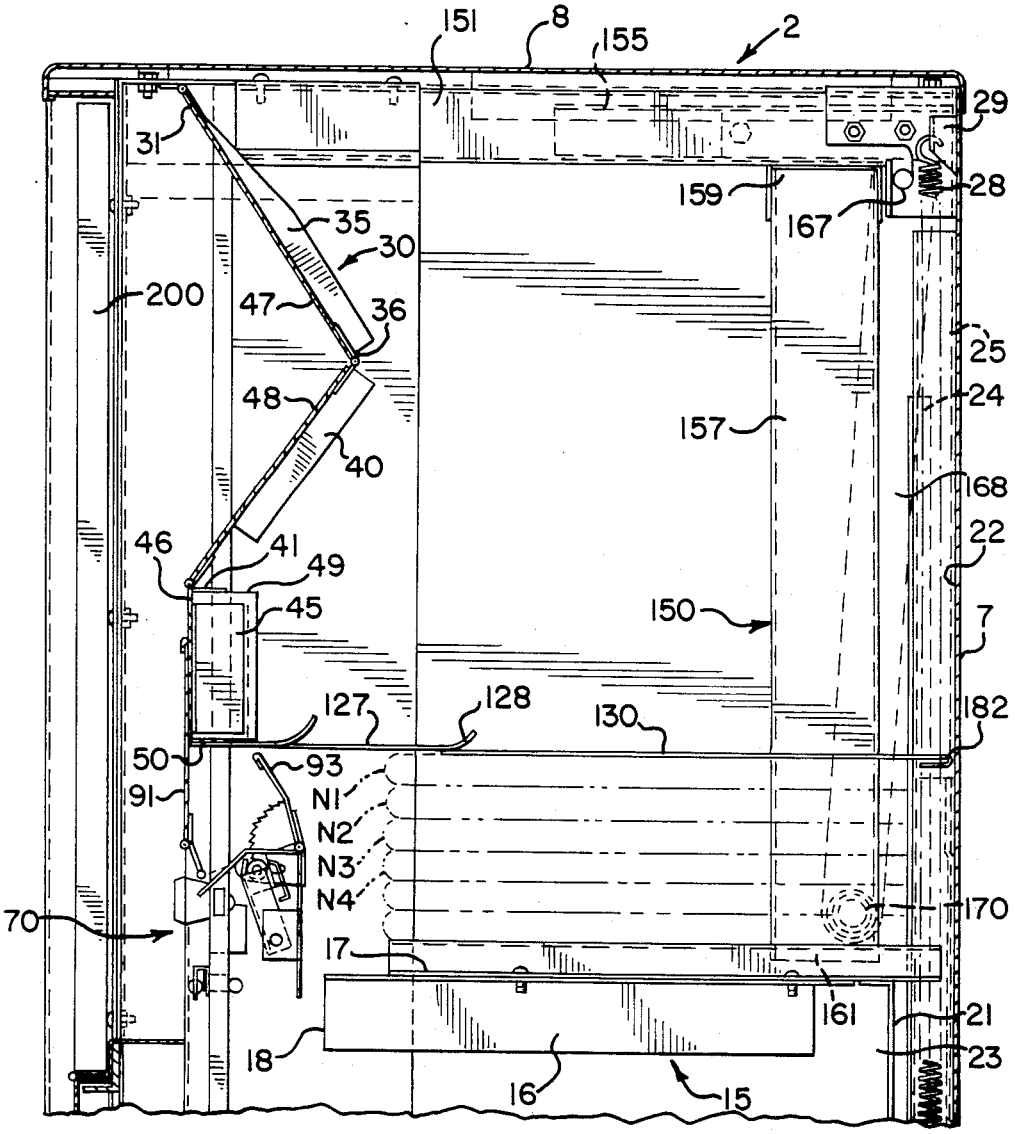
FIG. 4 is an enlarged partial sectional view of FIG. 1 as indicated by the section line 4—4 showing the interior components of the machine.
Figure 5:
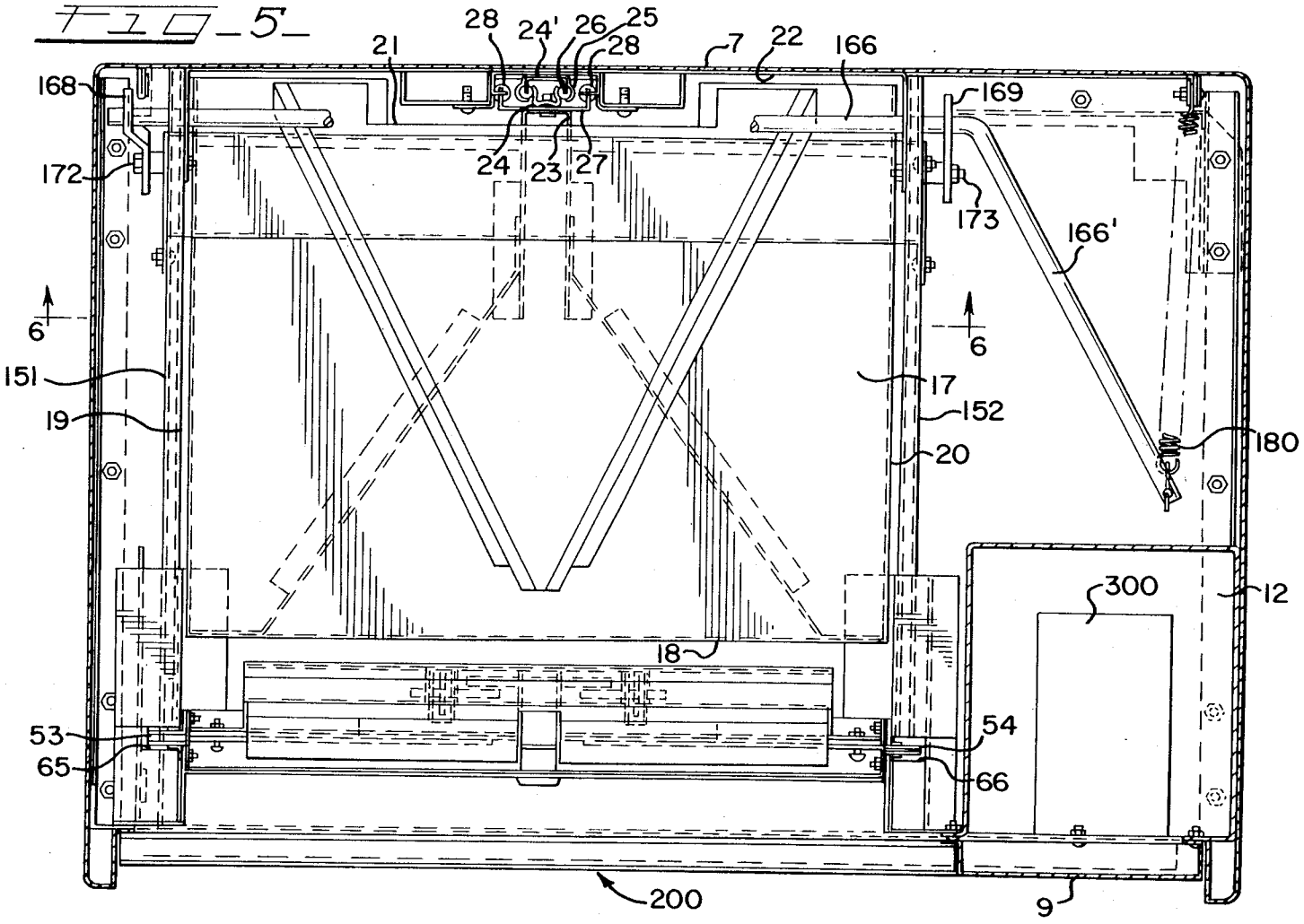
FIG. 5 is an enlarged top section view of FIG. 1 as indicated by the section line 5—5.

Referring to FIG. 4 which is a sectional partial side view of machine 2 and FIG. 5 which is a sectional top view of the machine 2, the operating component assemblies of the machine are comprised of the operating door assembly 200, an article support platform assembly 15, a closing means having a top or upper shutter assembly 30 and a bottom or lower shutter assembly 70, a dispensing carriage assembly 150 and the coin mechanism assembly 300, which is indicated in FIG. 5.

The article support means, such as newspaper support platform assembly 15, is comprised of a main support platform 16 having a substantially horizontally disposed top surface 17, a front end portion 18, a first and a second side portion 19 and 20, respectively, and a rear portion 21. Central or intermediate the two sides 19 and 20 and adjacent rear portion 21 an attachment means, such as attachment bracket 23, is affixed to platform 16. Affixed to a rear portion of bracket 23 is a movable slide member 24 which is slidably engaged with a fixed slide member 25 fixably engaged with a portion of an interior surface 22 of back enclosing wall 7. Platform assembly 15 is thus slidably engaged with and vertically movable with respect to back wall 7.

Friction reducing means, such as a plurality of balls 26, are positioned between members 24 and 25 and retained by a member 24' whereby the platform 16, bracket 23, bracket 24 and the balls 26, can move vertically up and down with respect to vertically extending fixed bracket 25. A stack of newspapers, such as newspapers N1, N2, N3 and N4, may be, as shown in FIG. 4, supported on platform 16 of assembly 15 and are therefore supportedly movable up and down with respect to the enclosure walls of machine 2.

A biasing connection means, such as bracket 27, is affixed to attachment bracket 23 and an appropriate biasing means, such as a pair of helical springs 28, are connected to bracket 27 and to an attachment bracket 29 affixed to surface 22 of wall 7 adjacent top cover 8. The springs 28 resiliently urge the platform assembly, and any articles supported on it, vertically upward. Platform assembly 15 is sized and arranged to not interferingly engage other components of the machine, with the exception of a component of top shutter assembly 30 and a paper pick-up member of the dispensing carriage assembly 150, in its normal range of vertical movement.

As shown in FIG. 4 at the front portion of the machine, a vertically extending closing means or shutter assembly, having a bifold upper shutter assembly 30 and a lower shutter assembly 70, is positioned in an opening between operating door assembly 200 and the interior of the enclosed cabinet to prevent uncontrolled access to newspapers, such as newspapers N1, N2, N3 and N4, stacked upon platform assembly 15.

Figures 10, 11, 12:
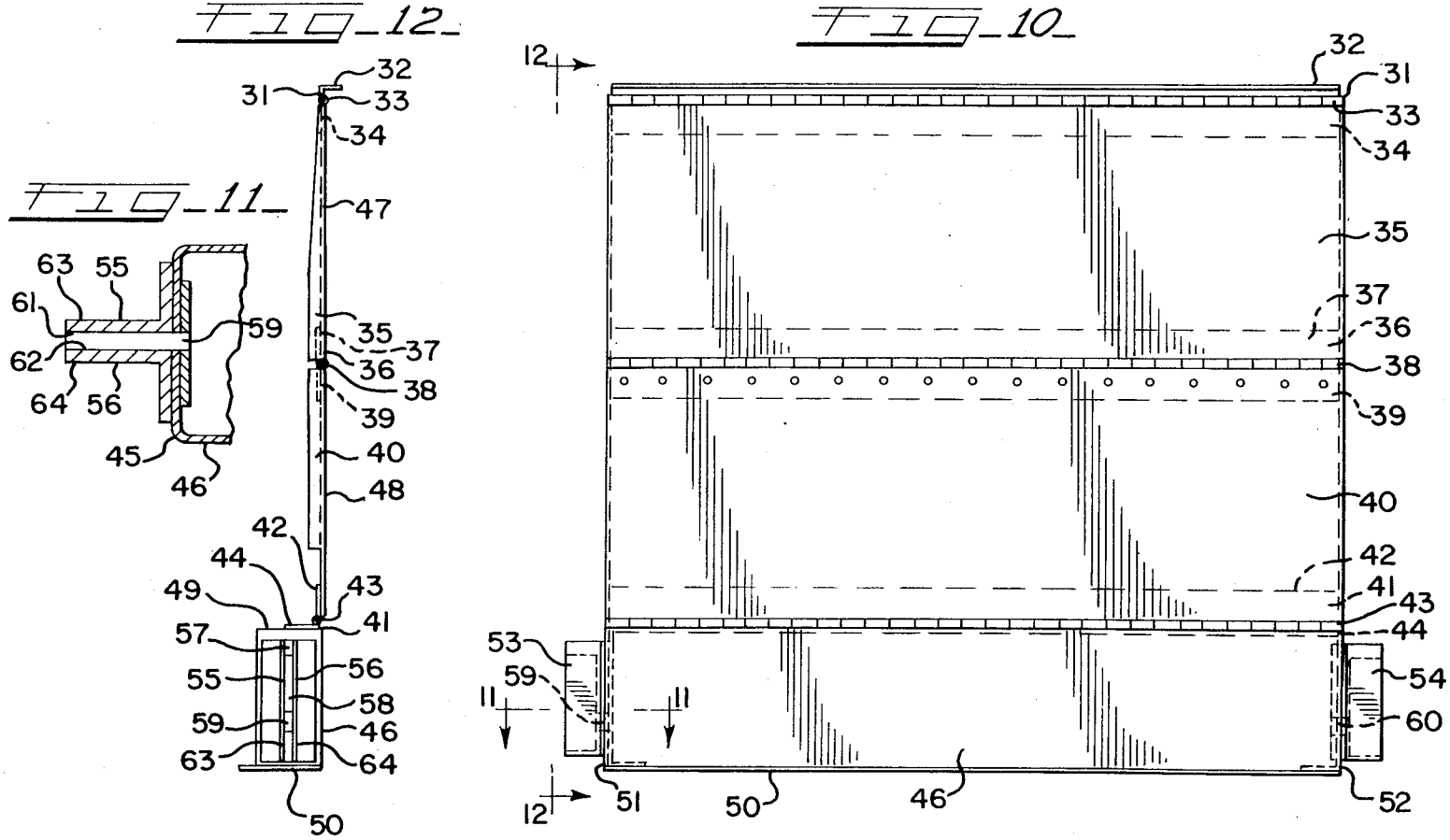
FIG. 10 is an enlarged frontal view of the upper shutter assembly.
FIG. 11 is an enlarged sectional view showing a sliding and locking structure of the upper shutter assembly.
FIG. 12 is a side elevation view of the shutter assembly of FIG. 10.

The closing means is comprised of, as shown in FIG. 4 but better shown in FIGS. 10, 11 and 12, a bifold door having a first or upper hinge 31 having a portion 32 affixed to an upper portion of machine 2 adjacent top cover 8, a hinge pin 33 and a lower portion 34 affixed with an upper portion of first or uppermost panel 35 of the bifold door 30. A second or intermediate hinge 36 having an upper portion 37 affixed to a lower portion of panel 35, a pivot pin 38 and a lower portion 39 affixed to a second or lower panel 40 pivotally engages the upper and lower panels for pivotal movement with respect to each other.

Second or lower panel 40 is connected by a hinge 41 having an upper portion 42 affixed to the lower portion of panel 40, a hinge pin 43 and a lower portion 44 affixed to a locking member 45 which is slidingly engaged with the enclosure of the cabinet. Member 45 has a frontal surface 46 which is substantially co-planar with the frontal surfaces 47 and 48 of the first and second panels, respectively, when the top shutter assembly is in its fully extended or unfolded position, as shown in FIG. 12.

Locking member 45 has a top portion 49, a bottom portion 50, a first end portion 51 and a second end portion 52. Extending longitudinally outward from each end portion 51 and 52 is a locking member guidance and engaging means, such as projections 53 and 54, respectively.

As best shown in FIGS. 11 and 12, each of the locking means 53 and 54, as specifically shown for means 53, is comprised of a first latch guide member 55, a second latch guide member 56 and a spacer member 57 interposed between members 55 and 56 to maintain a portion, as shown in FIGS. 11 and 12, laterally spaced from each other to form a latch guide channel 58 between them. Adjacent the rear or longitudinally innermost portion of locking means 53 and 54 a lock engaging means, such as notch or space 59 and 60, respectively, is provided. The internal or inward facing surfaces 61 and 62 of the latch guide members 53 and 54 which form latch guide channel 58 serve to maintain a locking member aligned for selective locking and unlocking engagement with the locking notches 59 and 60.

Figure 7:
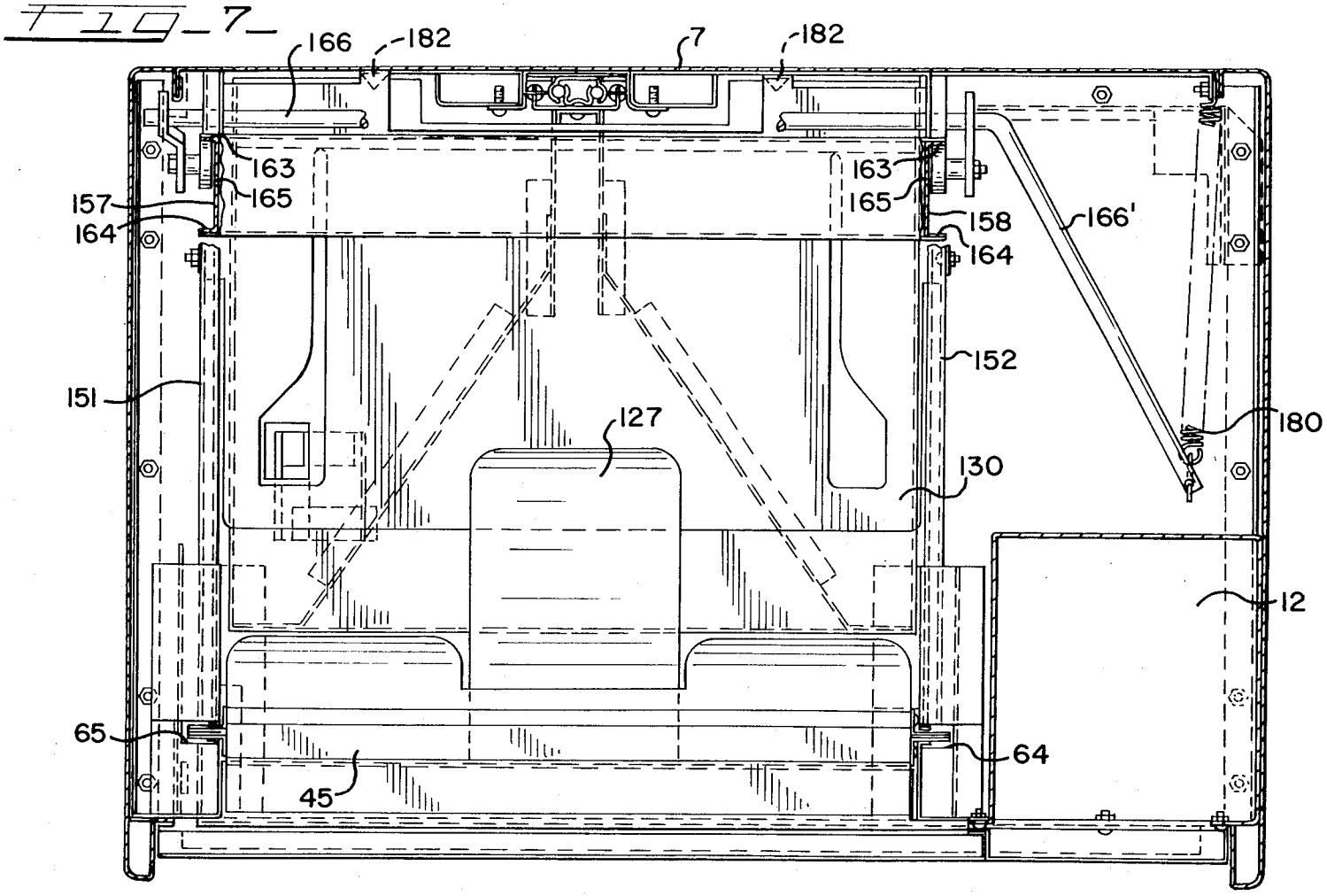
FIG. 7 shows the machine of FIG. 5 in which a paper engaging member is positioned on the paper platform and engaged with the dispensing carriage.

The exterior or outward facing surfaces 63 and 64 of the members 55 and 56 are slidably engaged for vertical movement within a shutter assembly guide channel means, such as guide channels 65 and 66, rigidly affixed to, and adjacent the front enclosure wall 4 of the machine, as best shown in FIGS. 5 and 7. The locking means 53 and 54 are, as shown, substantially identical in construction and function.

Figures 13, 14, 15:
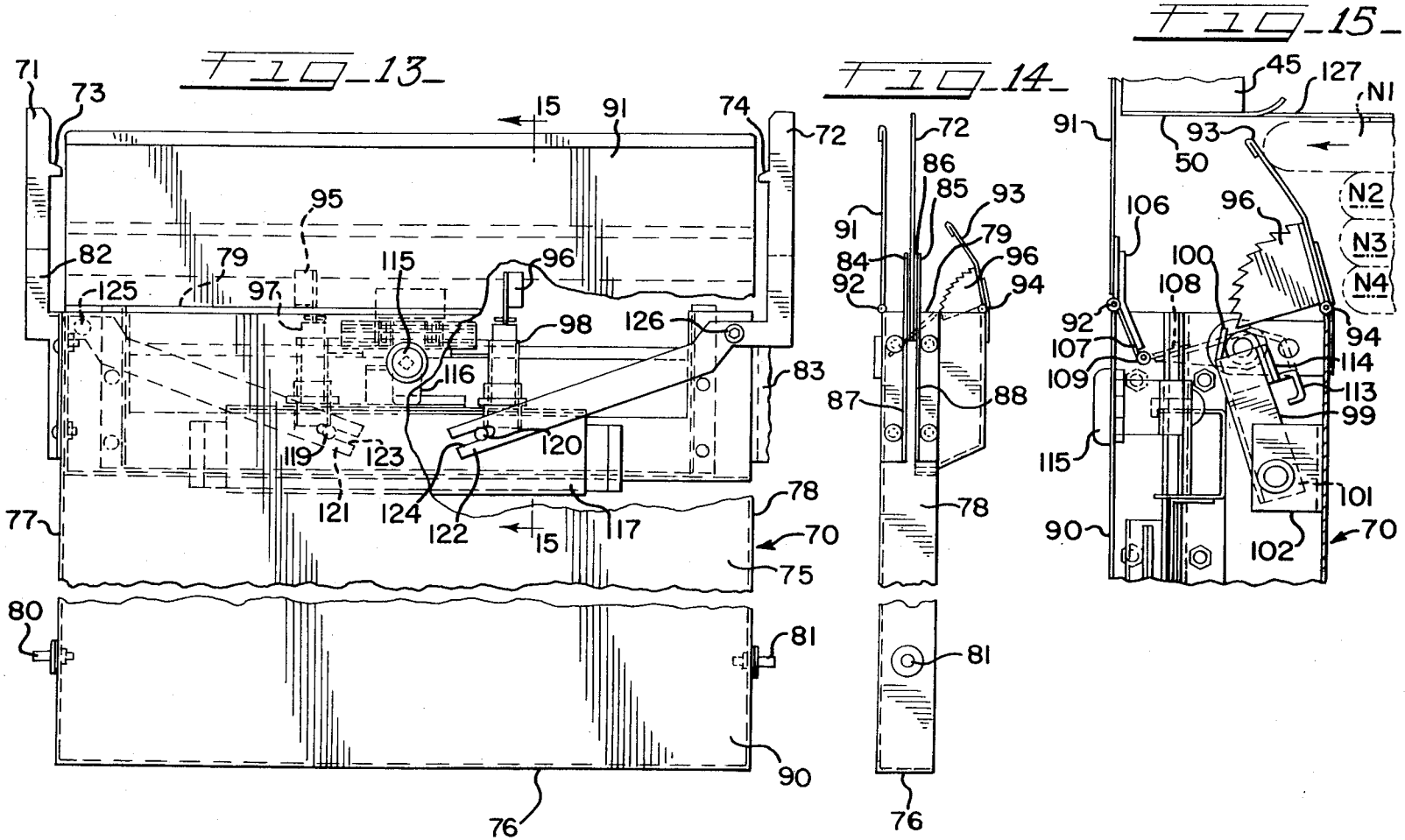
FIG. 13 is an enlarged partially broken away frontal view of the bottom shutter assembly.
FIG. 14 is a side elevation view of FIG. 13.
FIG. 15 is an enlarged sectional side view of the access opening barrier arrangement shown in FIG. 13 as indicated by the section line 15—15.

The closing means is further comprised of a lower shutter assembly 70, as shown assembled into the machine and coacting with upper shutter assembly 30 in FIG. 4 and shown in greater detail in FIGS. 13, 14, and 15. The lower shutter assembly has a pair of locking means, such as latch arms 71 and 72 having locking nibs 73 and 74 which are positioned in and guided by the latch guide channels in members 53 and 54 to enable the locking nibs 73 and 74 to be selectively lockingly and unlockingly engaged with the locking notches 59 and 60 of member 45 of the top shutter assembly 30.

Lower shutter assembly 70 is. comprised of a body portion 75 having a bottom portion 76, two side portions 77 and 78 and a top portion 79. Extending outward from each of the two sides 77 and 78 are guide means, such as lower body portion guide members 80 and 81 and upper body guide means 82 and 83. Each of the upper guide means 82 and 83, as best shown in FIG. 14, is comprised of a pair of guide members 84 and 85 laterally spaced from each other to form a latch arm guide channel 86 between members 84 and 85. An outward facing surface, such as surfaces 87 and 88, of the guide members 80 and 81, maintain the bottom shutter assembly engaged with guide channels 65 and 66 in the machine to enable the lower shutter assembly to move vertically up and down with respect to the machine.

An outer plate 90 of body portion 75 prevents access to the interior of the machine cabinet. At an upper portion of plate 90 adjacent top portion 79 an outer flap 91 is pivotally engaged with body portion 75 by appropriate means, such as a hinge 92, and an inner flap 93 is pivotally engaged with the inner side of top portions 79 by appropriate means such as hinge 94. Affixed to inner flap 93 for pivotal movement with the flap are motion limiting means, such as toothed ratchets 95 and 96.

A pair of pawl assemblies 97 and 98 are mounted for coaction with the toothed ratchets 95 and 96 to limit pivotal movement of inner flap 93. As best shown for pawl assembly 98 in FIG. 14, each pawl 97 and 98 has a main body portion 99 having a pawl 100 and a lower portion 101 pivotally mounted to a mounting bracket 102 affixed to the lower shutter assembly.

The pawl of each pawl assembly is aligned to interferingly engage the teeth of the respective ratchet 95 or 96 with which it is aligned. As shown, due to the configuration of the teeth on each ratchet. the pawls limit the extent to which the inner flap can open. As the inner flap is resiliently urged to its closed or upwardly extending position, as shown, by suitable means, such as a torque spring wrapped around the pivot pin of pivot mean 94 in a well-known manner (not shown), the pawls do not limit movement of the inner flap as it travels from an open position to the upright or closed position by the urging of the biasing closed means.

The outer flap 91 has mounted on it for pivotal movement with it a lever means 106 which is pivotally engaged at its lower portion 107 with a pawl activator means 108 by a pivot pin 109.

A biasing means urges the pawl assemblies to a closed or tooth engaging position. A well-known torque spring (not shown) coacting with bracket 102 and lower end 101 of body 99 and mounted on the pivot pin serves this purpose.

Similarly, the outer flap 91 is urged to its closed position, as shown in FIGS. 14 and 15, by a torque spring (not shown) acting on the pivot pin of hinge 92 and coacting with flap 91 and wall 90. As the spring on flap 91 maintaining it in the closed position, together with the leverage of lower end 107 of lever 106, exerts a greater force on pawl body 99 than the torque impelling the body 99 to a pawl engaging position the pawl tooth 100 stays out of contact with the teeth of the ratchet 96 until the outer flap commences to swing out to its open position.

Figure 16:
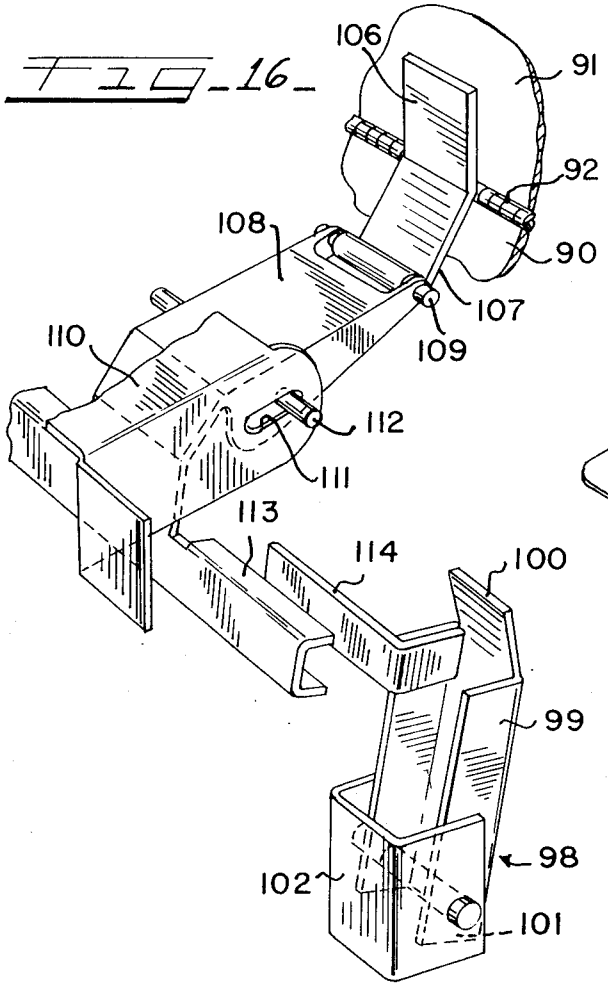
FIG. 16 is a partial perspective view showing the coaction of the pawl actuator member with the bottom shutter assembly control pawls shown in FIGS. 13, 14, and 15.

Operation of the flap 91, lever 106 and pawl activator 108 with one of the pawl assemblies 97 or 98 is best shown in the partial perspective view of FIG. 16 for pawl assembly 98. Each pawl mounting bracket 102 and a mounting and guide bracket 110 for activator 108 are affixed to the back or inner wall of lower shutter assembly 70. Bracket 110 has a slot, such as slot 111, in each of its two sides and a pin 112 extends through activator 108 and the slots on each side of bracket 110, such as slot 111, to pivotally and slidably engage pawl activator 108 with bracket 110.

Activator 110 is provided with a pair of laterally outwardly extending pawl contacting projections 113 which extend laterally outwardly from its inner end portion.

Each of the pawl assemblies 97 and 98 have a laterally inwardly extending projection, such as projection 114 of assembly 98, which is positioned to be contacted by a projection 113 of activator 108 when, as shown in FIG. 16, the flap 91 is in its closed or upwardly extending position. In this position each pawl surface 100 is held out of contact with the pawl teeth of ratchet members 95 and 96 of the inner flap 93 and inner flap 93, as shown in FIGS. 14 and 15, is free to pivot counterclockwise about hinge 94.

However, as best seen in FIG. 16, as flap 91 is forced to pivot outwardly by a paper contacting it, lever 106 pivots about hinge 92 with the flap. Consequently, end 107 of lever 106 travels upwardly and inwardly through an arc with respect to member 108, and members 106 and 108 pivot with respect to each other about pin 109. Simultaneously, member 108 is forced inwardly by means of pin 112 sliding inwardly along slot 111 as pin 109 is raised through the arc of travel. Projection 113 thus moves inwardly and, due to the pivotal movement of member 108 with respect to slot 111, downwardly, out of contact with projection 114 of the pawl assemblies 97 and 98. Consequently, each pawl, urged by its torque spring, will be urged into engaging its surface 100 with the teeth on a ratchet member 95 or 96 and inner flap 93 will thereby be prevented from further opening rotation about its hinge 94. As each projection 113 moves inwardly and downwardly upon opening of flap 91, these projections move beneath a projection 114 on the pawl. Therefore, as flap 91 is allowed to close by removal of a paper, each projection 113 travels inwardly and upwardly along an arc and, as the flap 91 goes completely closed, contacts a pawl flap 114 and urges the pawl outwardly to move a surface 100 out of engagement with the teeth on a ratchet member 95 or 96.

Lower shutter assembly 70 is provided with a cam lock 115 which has a cam 116 which coacts with a slide plate 117. Slide plate 117 is mounted on a fixed body 118 for sliding movement up and down with respect to the body 75 of the lower shutter assembly. Affixed to the slide plate 117 for movement with it are two latch arm activating studs 119 and 120. The lower end portion 121 and 122 of the bell-crank shaped latch arms 71 and 72 each has a slot 123 and 124, respectively, slidably engaged with one of the activating studs 119 and 120. Each of the bell-crank shaped latching arms are pivotally mounted to the body of the lower shutter assembly by appropriate means, such as pivot members 125 and 126. In the position shown in FIG. 13 the cam 116 is in the locked position in which slide plate 117 is cammed downwardly whereby latch arms 71 and 72 have their locking nibs swung inwardly about pivot points 125 and 126 and in this position the nibs would lockingly engage the lock notches 59 and 60 of upper shutter assembly 30. A substantial gap is provided between the lowermost portion of member 45 and the upper portion 79 of body 75 of the lower shutter assembly. The outer flap 91 and the inner flap 93 close this gap or dispensing opening through which each newspaper is ultimately dispensed. As best shown in FIG. 4, an alignment means, such as flat spring member 127, is affixed to the lower portion of member 45 and projects inwardly into the cabinet of the machine to slidingly contact, by virtue of the upcurved end 128 of the spring 127, a newspaper dispensing member 130 positioned above and supported by the uppermost newspaper N1 on the stack of newspapers. In this way, due to the vertical sliding ability of the now locked together upper and lower shutter assemblies with respect to the cabinet the gap or dispensing slot between the upper and lower shutter assemblies is maintained properly aligned with the vertically movable platform and the uppermost paper on it to receive the uppermost newspaper during a vend cycle.

Figure 9:
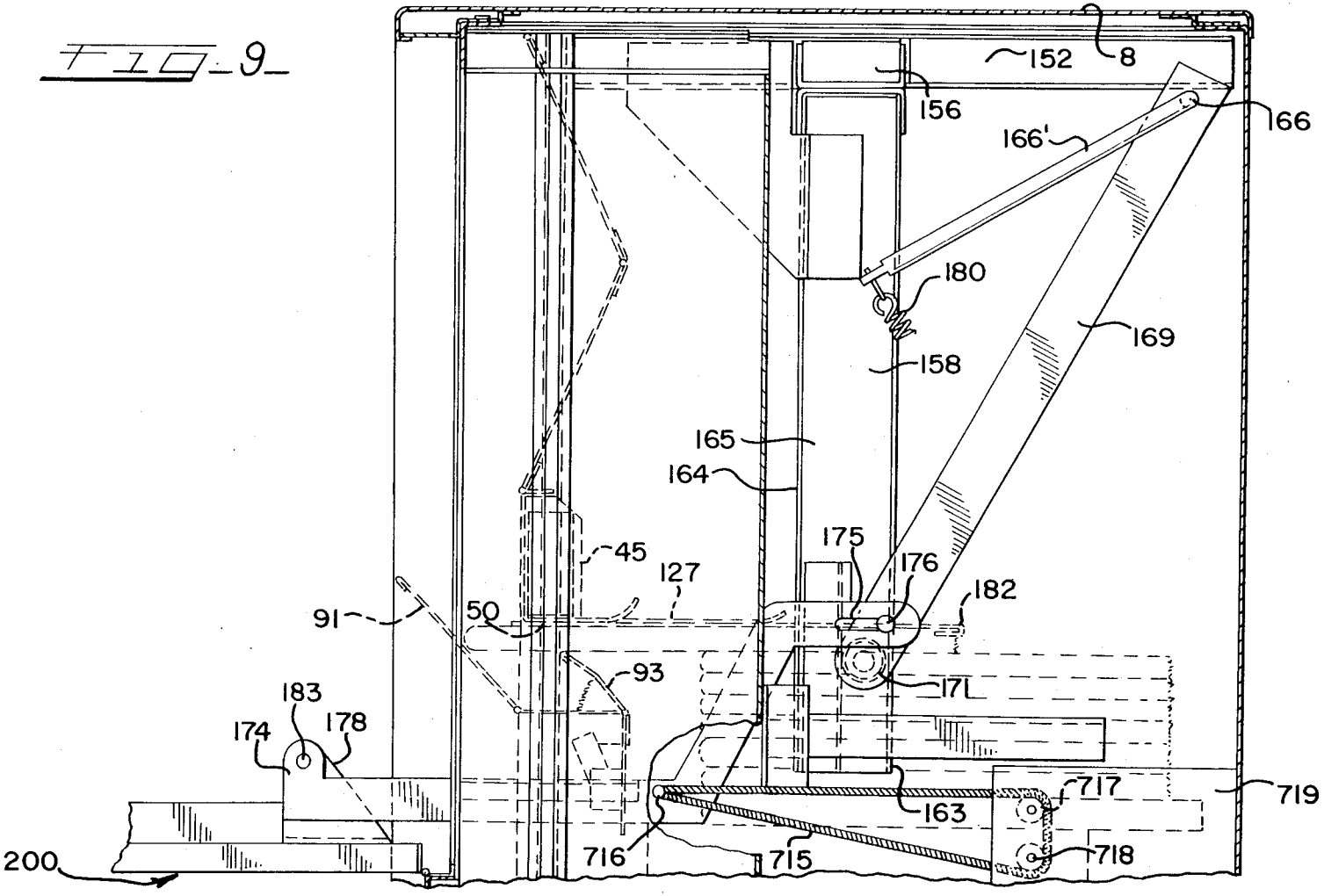
FIG. 9 shows the machine of FIG. 8 with the operating door opened.

The uppermost newspaper on the stack on the support platform, such as newspaper N1 as shown on platform 16 in FIG. 9, is dispensed partially through the dispensing slot by a dispensing means having a carriage assembly 150.

Figure 6:
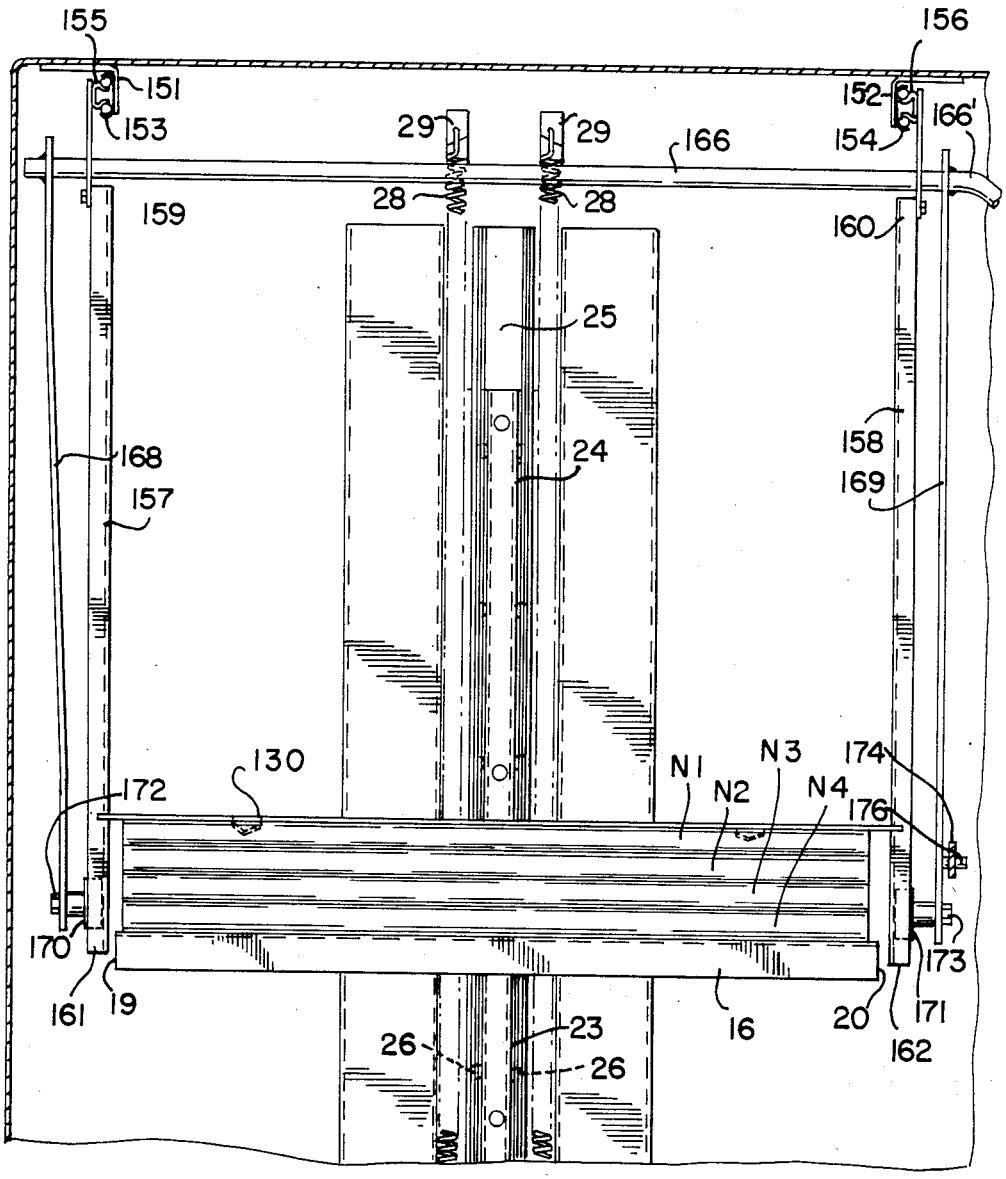
FIG. 6 is a cut-away frontal elevation view of the dispensing carriage and support platform of the machine.

As best shown in FIGS. 6 and 7, carriage assembly 150 is comprised of a carriage support means, such as a first carriage slide 151 and a second carriage slide 152. Slides 151 and 152 are affixed to the cabinet enclosure at each back wall 7 and front wall 4 and extend substantially from the front to the back of the machine immediately beneath top cover 8. Each of the slides 151 and 152 is preferably a ball bearing slide, similar to the platform slide comprised of members 24, 24', 25, and 26. Each slide 151 and 152, as best shown in FIG. 6, has a fixed portion 153 and 154, respectively, and a movable portion 155 and 156, respectively, slidable on ball bearings with respect to the fixed portion.

Affixed to and depending downwardly from each of the movable portions are a first and second carriage operation channel bar 157 and 158. Each bar 157 and 158 is attached at an upper end 159 and 160, respectively, to a movable portion of the carriage slides 151 and 152 and each bar 157 and 158 depends downwardly substantially normal to the slide to which it is attached and terminates at a lower end 161 and 162, respectively. Lower ends 161 and 162 are laterally outwardly spaced from sides 19 and 20 of platform 16 and consequently the carriage operator channel bars are movable from back to front and visa versa with respect to the platform 16 and any papers, such as N1 through N4, stacked upon platform 16.

Due to the fact that paper pick-up member 130 is engaged with each of the channel operator bars 157 and 158 pick up member 130 moves back and forth as the bars 157 and 158 move back and forth. Also, member 130 is able to move vertically up and down with respect to channel bars 157 and 158 to remain engaged with the uppermost newspaper on the stack, such as, as shown, newspaper N1.

As best shown in FIG. 7 in a sectional top view of channel bars 157 and 158, each bar is comprised of a first laterally extending side 163, a second laterally extending side 164 and a laterally inner connective wall 165 to form a laterally outward facing substantially U-shaped channel substantially the full length of each of the channel bars.

As shown in FIGS. 6 and 7, a pull back means, such as pull back rod 166, is pivotally engaged to a fixed mounting means, such as a pair of fixed brackets 167, adjacent members 153 and 154. Affixed adjacent a first end of rod 166 is an actuator arm 168 and affixed adjacent a second portion is an actuator arm 169. Each arm is affixed to the rod by appropriate means, such as welding, whereby the actuator arms and rod pivot together.

At a lower end portion of each of the arms 168 and 169 is mounted an operator means, such as rollers 170 and 171, respectively, which are engaged with the channel of an operator channel bar. Rollers 170 and 171 are mounted for rotational movement about an axis, such as bolts 172 and 173.

For operatively connecting the operator door to the dispensing carriage an actuator linkage member 174 is connected by an opening, such as slot 175, to a stud 176 mounted on actuator arm 169. An opposite end 177 of actuator linkage member 174 is, as best shown in FIG. 8, pivotally engaged with a connection bracket 178 affixed to operator door assembly 200.

Figure 8:
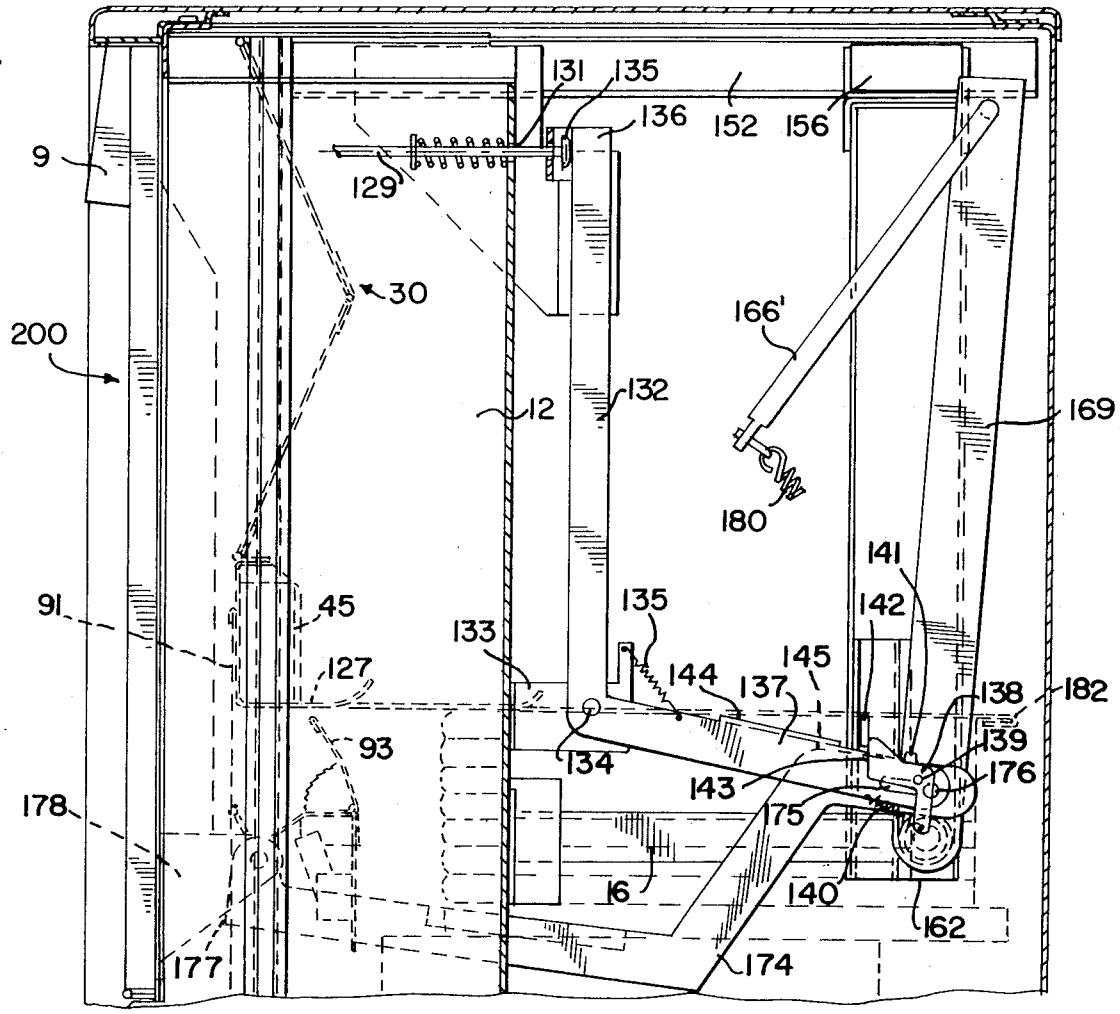
FIG. 8 is an enlarged side sectional view of the machine showing the operating door closed.

Referring to FIG. 8 in which the operator door assembly is shown in its closed position actuator linkage member 174, coacting with a biasing means, such as helical spring 180, to a lever arm 166' which is an eccentric extension of pull back rod 166 and to a rearward location, such as back wall 7, urges actuator arms 168 and 169 and, consequently, channel arms 157 and 158 to their rearward or paper pick up position. Paper pick up member 130, by having paper engaging means, such as engagement hooks 182, is thus positioned to engage an edge portion of the unfolded back edge of paper N1. As member 130 moves horizontally with the channel arms and is free to move vertically with respect to the channel arms 157 and 158 to be maintained in contact with the top paper on the stack, such as paper N1, member 130 is, as shown in FIG. 8, ready to engage a portion of the rearmost portion of the top or uppermost paper N1 and slidingly move it forward as the dispensing carriage assembly is caused to move forward by the opening of the operator door.

FIG. 9 shows the machine as shown in FIG. 8 in which the operator door assembly is open and during the opening the carriage assembly was caused to move forward and be forced past inner flap 93 and outer flap 91 to protrude through the dispensing gap or slot formed between the top and bottom shutter assemblies 30 and 70, respectively.

As shown in FIG. 9, as the operator door assembly is manually pivoted open about hinge 10 operator bracket 178, by being affixed to the door, is forced to rotate through an arc and, due to the end portion 177 of linkage member 174 being pivotally engaged with bracket 178 by appropriate means, such as a pivot pin 183, member 174 imposes a forward force on pin 176 causing the lower end portions, and the rollers 170 and 171 pivotally affixed to them, of each of the actuator arms 168 and 169 to pivot forward about pull back rod 166. As the rollers move forward they engage the forward laterally outward extending wall 164 of each of the channel arms 157 and 158 to cause the slidably movable portion 155 and 156 and arms 157 and 158 to move forward. This forward movement causes paper pick up 130 and the uppermost paper N1 to which it is engaged to move forward also. Thus paper N1 slides over the top surface of paper N2 as the lower surface of end portion 128 of member 127 slides along the top surface of member 130 to maintain forward moving paper N1 aligned with the dispensing gap or slot between the shutter assemblies. The forward or protruding end 190 of paper N1 is now accessible to be grasped by the customer. After the paper is manually withdrawn through the slot by the customer the spring loaded flaps 91 and 93 return to their closed position as shown in FIGS. 4, 13, 14, and 15 and, due to spring 180 imposing a biasing force rearwardly on eccentric extension 166' of pull back rod 166, the entire carriage assembly and paper pick up 130, sliding over the top of now uppermost newspaper N2, are urged back to the position shown in FIG. 8 whereby paper engaging members 182 fall off the back edge of paper N2 and downward by gravity to be in a position to engage and slide forward paper N2 on the next vend cycle.

As shown in FIG. 9, door assembly 200 is resiliently urged from its open position to a closed position by a helical spring 715. Spring 715 has each of the two ends attached to a portion of linkage arm 174 by appropriate means, such as a threaded fastener 716. The loop formed by the body of the spring between the two ends is placed over a pair of spaced apart rollers 717 and 718, which are rotatively engaged with a support base, such as fixed support plate 719. Rollers 717 and 718 have grooves on their peripheral surface which are substantially semicircular in cross section and spring 715, which is substantially circular in cross section, is maintained rollingly and stretchingly engaged with the rollers. Door assembly 200 is by this arrangement pivotally opened manually against the urging force of spring 715 and automatically urged closed by spring 715.

Forward movement of the carriage assembly is limited by appropriate limit means, such as forward interference bracket 184 affixed to slide member 152, as shown in FIG. 9.

Opening 175 in actuating link 174 is, as shown, in FIGS. 8 and 9, formed as an elongated slot. Pin 176 is engaged with the slot in a longitudinal lost motion relationship. This lost motion relationship assures that the door assembly 200 is securely locked after a vend cycle and prior to the time the paper engaging member is carried back into position to engage the next paper. This, as explained in greater detail below, prevents a repeat of a vend cycle without deposit of the required amount of coins.

FIGS. 8, 41 and 42 show a carriage movement central arrangement placed in machine 2 to prevent a customer from opening the operator door, withdrawing a dispensed paper and then almost closing the door, but, just before the door is locked and after paper engaging members 182 of member 130 have traveled completely to the rear of the paper and fallen down to engage the topmost paper, opening the door and having another paper dispensed without the deposit of any additional coins.

Referring to FIG. 8, the control arrangement is comprised of a push rod 129 which is slidably movable longitudinally through an opening 131 in the back wall of coin compartment 12. A crank plate 132 is pivotally engaged with a bracket 133 affixed to the back wall of compartment 12 by a pivot means, such as threaded fastener 134. A biasing means, such as spring 135 is engaged with each the bracket 133 and the crank plate 132 to resiliently urge plate 132 counterclockwise about pivot pin 134. An inner end 135 of rod 179 is engaged with an upper end portion 136 of plate 132. A lower inwardly extending portion 137 of plate 132 has a pawl 138 pivotally engaged with it by a pivot pin 139. A spring 140 engaged to each pawl 138 and portion 137 of crank 132 resiliently biases the pawl clockwise against a pawl stop 141 which limits clockwise rotation of the pawl. A laterally outwardly extending engagement bracket 142 affixed to channel bar 158 is positioned to interferingly engage an engagement surface 143 of pawl 138.

At an upper portion of portion 137 of plate 132 an engagement lip 144 is affixed to the crank plate. Lip 144 extends laterally inwardly to overlie actuator linkage member 174. Lip 144 is positioned to interferingly engage portion 145 of member 174 and prevent clockwise movement of plate 132 until the door has been closed to substantially the extent shown in FIG. 42.

As best shown in FIGS. 41 and 42, as door assembly 200 is closed, latch flap 501 intrudes through opening 346 and moves into engagement with cam surface 344 and lock catch 345. As shown in FIG. 42, an inner end of the latch flap 501 contacts an end of the push rod 129 and, as the door closes, pushes the rod inwardly. Simultaneously, linkage 174 is allowing the dispensing carriage to be urged rearwardly by spring 180 (see FIG. 5) attached to the pull back bar attached to member 162.

As the dispensing carriage travels rearwardly, it reaches a point, as shown in FIG. 42, where surface 143 engages bracket 142 and prevents additional rearward movement of channel bar 158. Due to lip 144 overlying surface 145 of member 174, crank plate 132 cannot be moved clockwise about pivot 134 until, as shown in FIG. 42, surface 145 has been moved sufficiently far inward to be out of interfering engagement with the underside of lip 144. After surfaces 142 and 143 interferringly engage, continued closing of the door causes linkage 174 to move with respect to member 169 by having slot 175 slide rearward with respect to pin 176. As shown in FIG. 42, as the door is pushed further inward to close flap 501, via push rod 129, moves crank plate 132 clockwise about pivot 134. Clockwise movement of plate 132 will cause pawl 138 to be moved downward with plate portion 137, and consequently surface 143 will be withdrawn from engagement with bracket 142. Member 158 and, consequently, member 169 will then be free to move rearward, and consequently, due to the urging of spring 180, the dispensing carriage and pick-up member 130 will travel the distance of the length of slot 175 and pin 176 as pulled from the front to the rear of the slot. Consequently, only when the door is substantially completely closed and flap 501 is lockingly engaged with catch 345 are the members 182 of member 130 able to reach the paper pick-up position shown in FIG. 4, in which they are ready to engage the topmost paper and move it forward on the next vend cycle. This arrangement precludes the possibility of a customer closing the door far enough to have the hooks 182 of member 130 engage a paper when the door is almost closed after completion of a vend cycle, and then, just before flap 501 lockingly engages catch 345, jerk the door open again to have another paper dispensed without the deposit of another set of coins. Lip 144 above portion 145 assures the pushrod cannot be operated manually as the door has to be closed far enough to exclude fingers from the opening before the flap contacts the pushrod and pushes pawl 138 downward.

Figure 17:
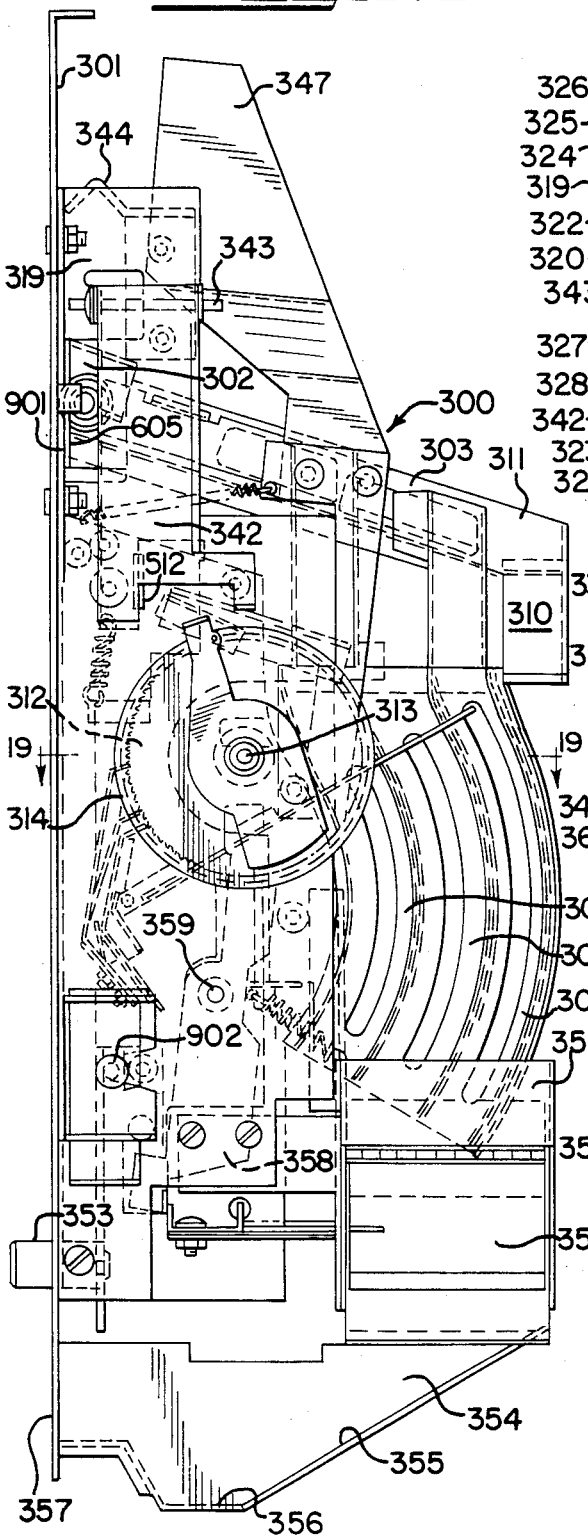
FIG. 17 is a side elevation view of the coin receiving mechanism of this invention.
Figure 18:
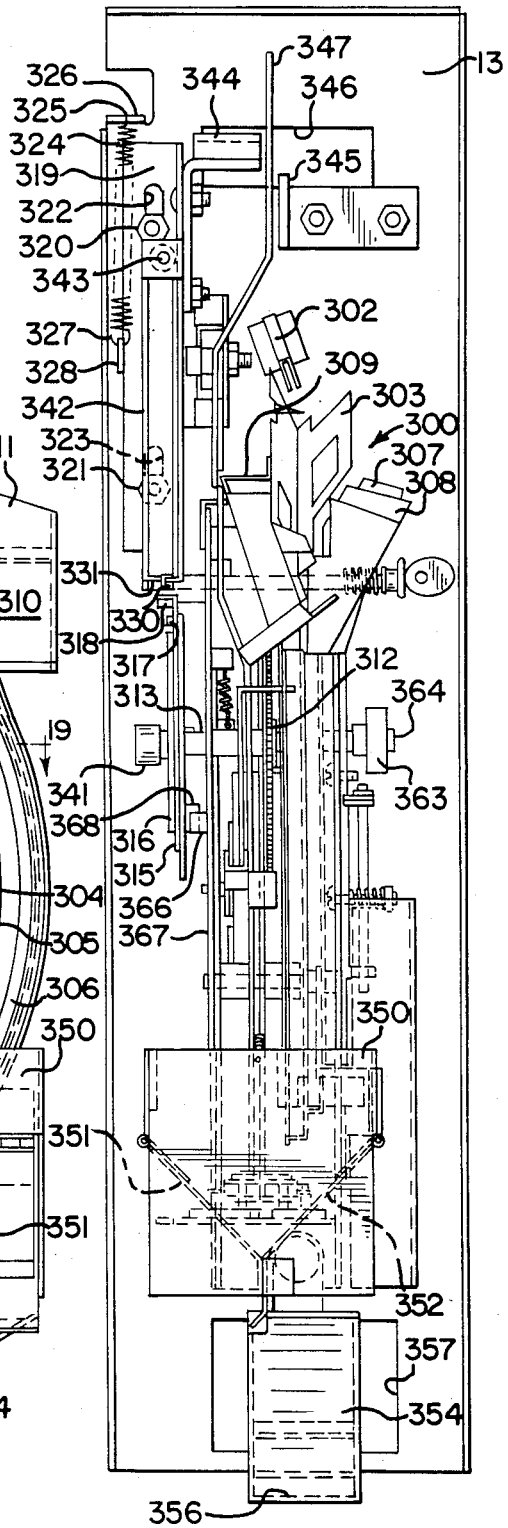
FIG. 18 is an end view of the coin mechanism of FIG. 17.
Figure 19:
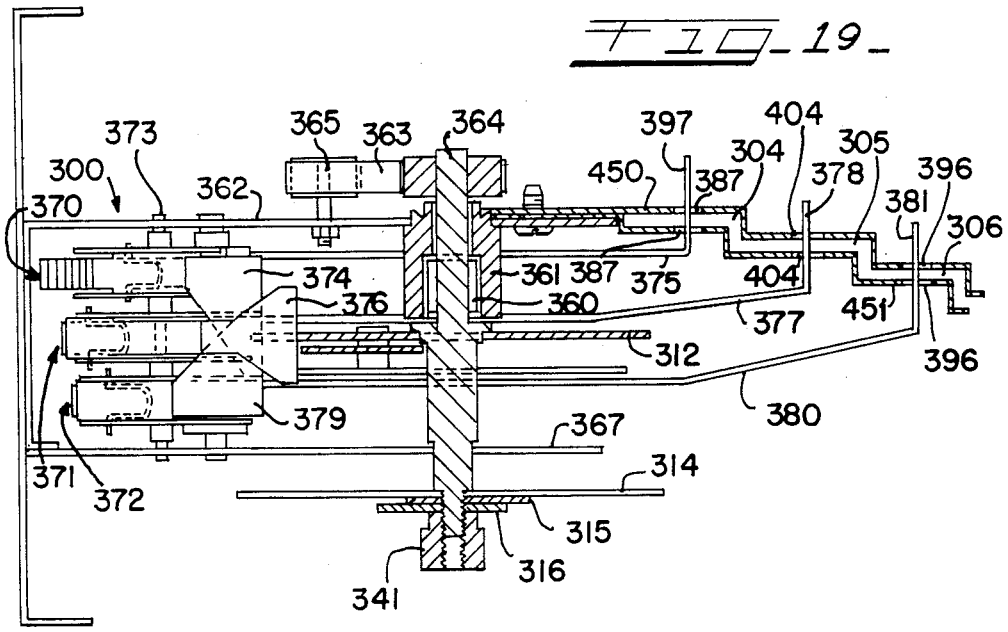
FIG. 19 is a sectional view of the coin mechanism shown in FIG. 17 as indicated by the section line 19—19.

FIGS. 17, 18, and 19 show a coin mechanism assembly 300 which may be placed in coin compartment 12 of the enclosure cabinet of machine 2. Coin mechanism assembly 300 is removably mounted on access door 13 of compartment 12 and is positioned to receive coins inserted through coin deposit opening or slot 14, as shown in FIG. 1.

Assembly 300 is removably affixed to an inner surface of access door 13. Coin slot 14 is formed in and extends through door 13 and is provided with a coin guide sleeve 302. A coin separator or sorter 303 is positioned on assembly 300 to receive coins from the slot 14 and guide each coin deposited to its correct position or location in the coin mechanism. Three coin chutes 304, 305, and 306 are provided in assembly 300. Chute 304 receives nickels, chute 305 receives quarters, and chute 306 receives dimes.

A connector chute 307 receives nickels from separator 303 and guides them to chute 304. Similarly, a connector chute 308 guides quarters from separator 303 to chute 305 and a connector chute 309 guides dimes from separator 303 to chute 306. A penny guide 310 positioned at an inner end 311 of coin sorter 303 diverts pennies to a suitable location, such as the bottom of the coin compartment 13. Pennies are not received and processed by coin mechanism 300 and consequently they merely poss through sorter 303 and drop into the bottom of the coin compartment.

Figure 28:
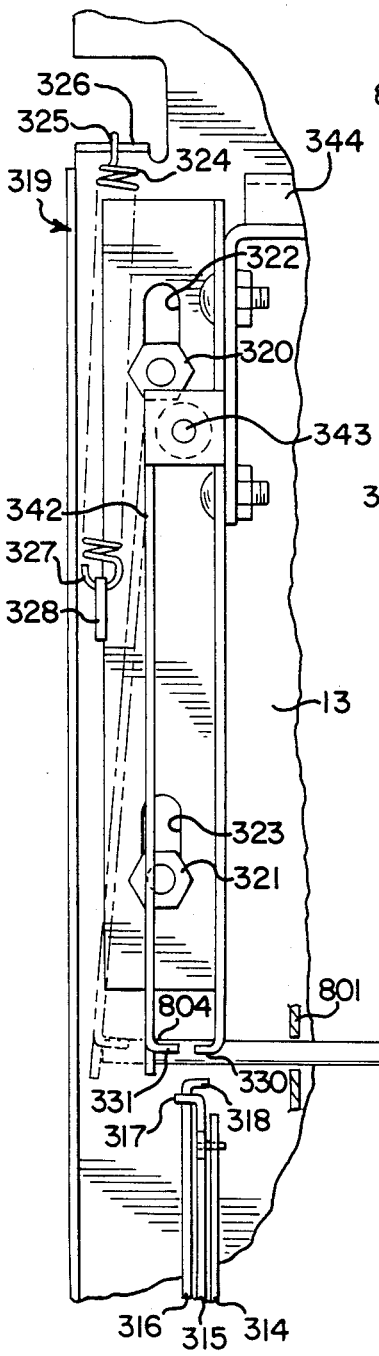
FIG. 28 is a partial view of the coin mechanism showing the cam slide member, which coacts with the price setter wheel of the coin mechanism, in enlarged detail.

Coin mechanism assembly 300 has a coin value accumulator means or totalizer body, such as toothed wheel 312, mounted to rotate with shaft 313. Also mounted and keyed for rotation with shaft 313 is a price setter wheel 314 having two adjustable price setter members 315 and 316. Price setter members 315 and 316 each have a working end 317 and 318, respectively, selectively adjustable to interferingly engage a door latch actuator cam member 319 slidably engaged with access door 13. As best shown in FIGS. 18 and 28, member 319 is slidably engaged to door 13 by fasteners 320 and 321 which are engaged in elongated slots 322 and 323, respectively, to enable the actuator member 319 to slide up and down with respect to access door 13. A biasing means, such as helical spring 324, having a first end 325, engaged with a bracket 326 affixed to plate 301 and a second end 327 engaged with an attachment bracket 328 affixed to actuator member 319 urges member 319 upwardly toward bracket 326.

Actuator member 319 has two working surfaces 330 and 331. Surface 330 is postioned to interferingly engage working surface 317 of price setter member 315 and surface 331 is positionable to interferingly engage surface 318 of price setter member 316. An adjustment means, such as a knurled set nut 313 is threadedly mounted on the shaft adjacent the price setter wheel to enable each price setter member 315 and 316 to be placed in a desired position with respect to price setter wheel 314.

Figure 29:
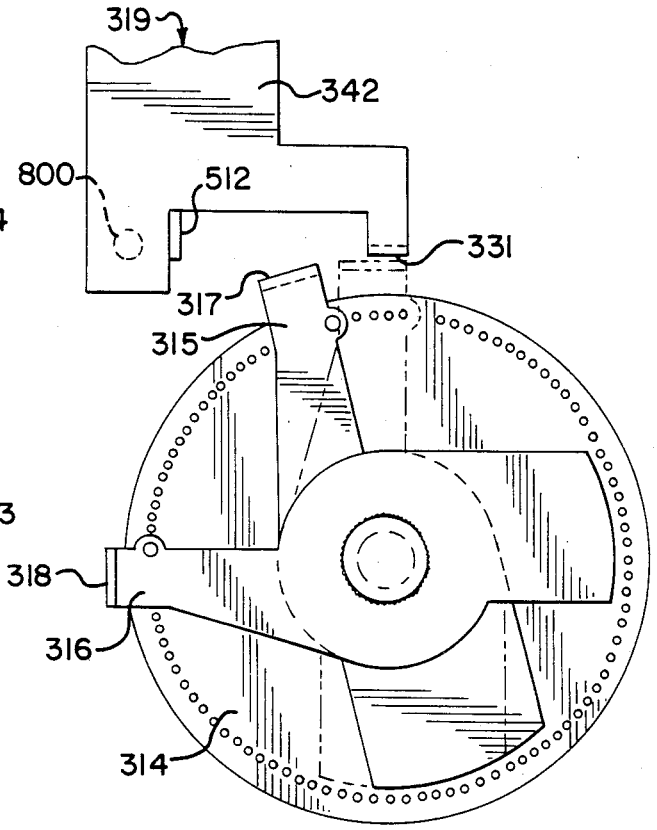
FIG. 29 is a partial elevation view of the coin mechanism showing in enlarged detail the price setter wheel and price setter members of the coin mechanism.
Figure 29:
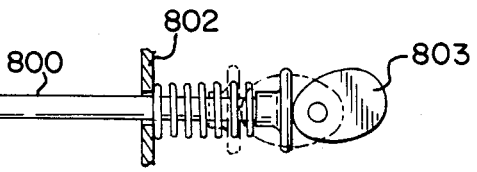

Also, preferably, as best shown in FIG. 29, a plurality of holes or openings are provided in price setter wheel 314. In the preferred embodiment ninety-eight holes are provided at 3.6° intervals about the wheel. Each hole represents five cents and each of the price setter members 315 and 316 have a member, such as a pin selectively engagable with the holes, to enable the price to be set from five cents to ninety-eight times five cents or, specifically, $4.90. Each hole on the price setter wheel corresponds to a tooth of the ratchet wheel, which has one hundred teeth. Two holes are omitted from the price setter wheel to provide a dwell space.

Surface 331 is a lower portion of a member 342 which has an upper portion pivotally engaged, by appropriate means, such as by pivot pin 343, with member 319. A door latch cam member 344 is affixed to member 319. Affixed to the inner surface of access door 13 is a lock catch member 345.

Figure 30:
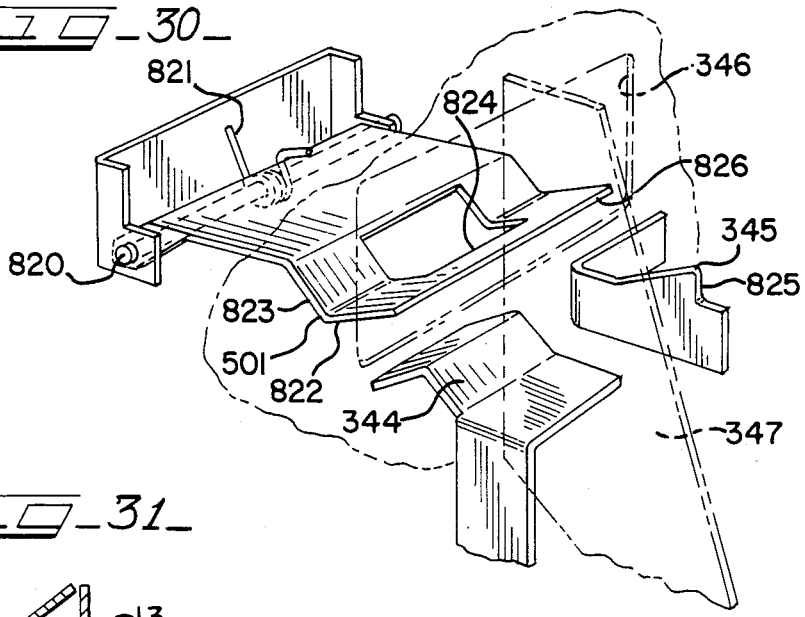
FIG. 30 is a partial perspective view showing the relationship of the door lock flap to the cam slide member and locking catch.
Figure 31:
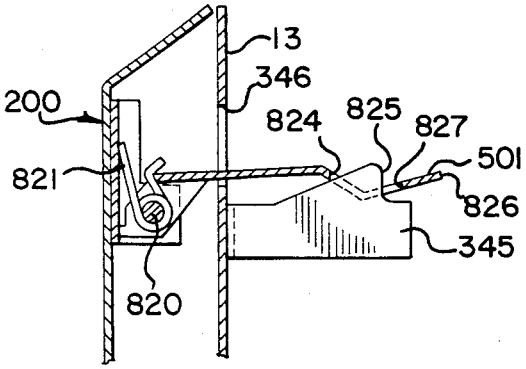
FIG. 31 is an enlarged elevation view showing the relationship of the door lock flap and the cabinet locking catch in the locked position.
Figure 32:
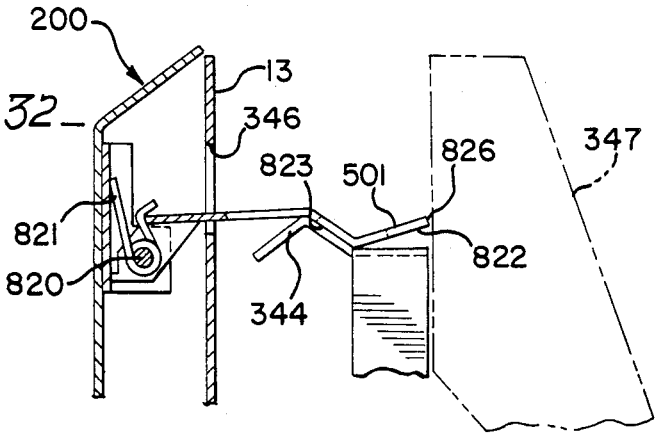
FIG. 32 is an enlarged elevation view showing the relationship between the door lock flap and the cam of the sliding cam member when the door is closed.

Lock catch member 345 and cam member 344 are, as shown in FIG. 18 and better shown in FIGS. 30, 31 and 32, aligned with an opening 346 in the access door 13. Also aligned with opening 346 is an ejector lever 347.

Coin mechanism assembly 300 has a coin receptacle or escrow box 350 positioned beneath coin chutes 304, 305, and 306. Escrow box 350 has a pivotally mounted coin deposit door 351 and a pivotally mounted coin return door 352. A coin return button 353, upon being pushed inwardly, causes coin return door 352 to be opened causing the coins in the escrow box to fall into a coin return chute 354 having a ramp 355 and a coin well 356. An opening 357 in access door 13 enables a customer to insert a finger through the opening and remove the coins in the coin well from the coin return chute.

A lower end 358 of reset lever 347 serves to open coin deposit door 351 upon opening of operator door 200 to cause the coins in escrow box 350 to fall into the bottom of compartment 13 to serve as payment in full for a dispensed paper. Ejector lever 347 is mounted for pivotal movement by pivot pin 359. The pivot pin 359 pivotally engages the lever 347 to the body of assembly 300.

As best shown in FIG. 19, shaft 313 with ratchet wheel 312 and price setter wheel affixed on it for rotation with it, is mounted in a friction reducing means, such as roller bearing assembly 360 engaged with a housing 361 affixed to a body member 362 of assembly 300. A biasing means, such as constant force spring 363, is engaged with an end portion 364 of shaft 313. Spring 363 has a portion 365 engaged with body member 362 of assembly 300. Constant force spring 363 serves to continually urge shaft 313 and the ratchet wheel 312 and the price setter wheel 314 mounted on it conterclockwise to a "zero" position. As best shown in FIG. 18, a fixed stop 366 is affixed to a body member 367 of assembly 300 and a movable stop member 368 affixed for rotation with price setter wheel 314 interferingly engages fixed stop 366 to assure the price setter wheel is always returned by spring 363 to the same "zero" position upon completion of a vend cycle.

Referring again to FIG. 19, it will be seen that three pawl and lever assemblies 370, 371, and 372 are pivotally mounted on a shaft 373. Shaft 373 extends between and is pivotally affixed to body members 362 and 367 of assembly 300. As shown, also affixed to body member 367 is a first stepped coin chute forming member 450 and a second stepped coin chute forming member 451 which form coin chutes 304, 305, and 306.

Assembly 370 is comprised of a pawl 374 and a lever 375 having an end portion 376 which extends through nickel coin chute 304. Assembly 371 has a pawl 376 and a lever 377 having an end portion 378 which extends through quarter coin chute 305. Similarly, assembly 372 has a pawl 379 and a lever 380 having an end portion 381 which extends through dime coin chute 306.

Figure 20:
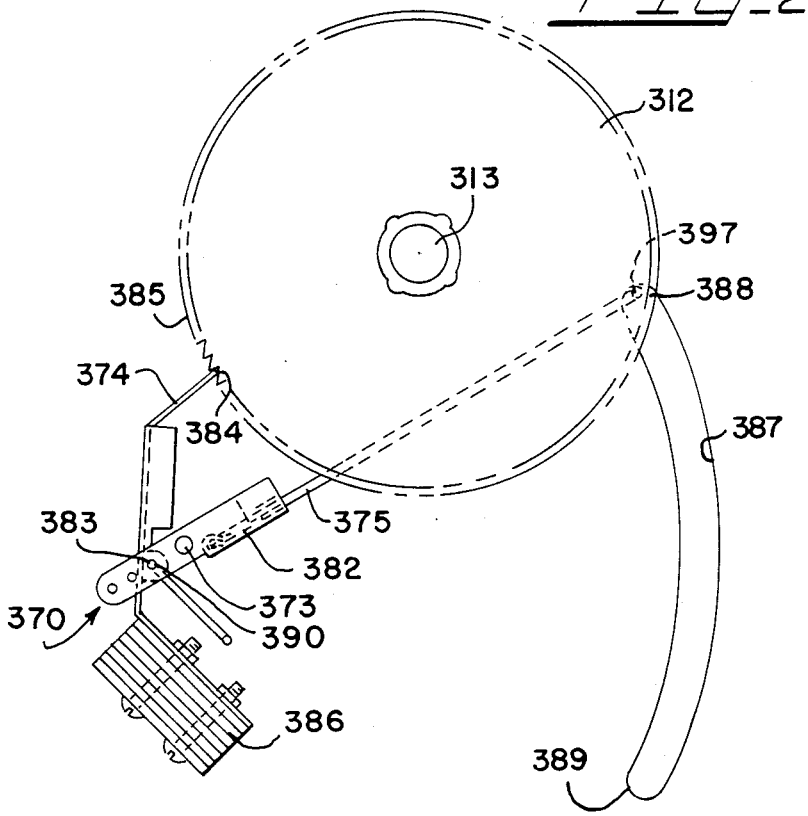
FIG. 20 is an elevation view showing the five-cent register of the coin mechanism.

FIG. 20 shows an enlarged detail view of pawl and lever assembly 370. Pawl 374 is pivotally mounted on a mounting body 382 by a mounting pin 383. Pawl 374 has a working end 384 in contacting engagement with the periphery 385 of ratchet wheel 312. A biasing means, such as counterweight 386, urges the end 384 of the pawl into contact with the wheel.

An end portion 397 of arm 375 is bent at substantially a 90-degree angle to arm 375 and extends through a pair of elongated arcuate openings 387 that extend through the walls of chute 304, from the uppermost portion 388 of openings 387 to the lowermost portion 389 is formed an arc of 60 degrees through which the end 397 of lever 375 is forced to travel as a nickel or five-cent piece travels through chute 304 whereby the weight of the nickel causes the pawl and arm assembly 370 to pivot clockwise about mounting pin 373. Due to mounting of pawl 374 in the first pivot opening 390, 60-degree pivotal movement of the assembly causes ratchet wheel 312 to advance clockwise 3.6 degrees or one tooth against the urging of constant force spring 363. When the end 397 of lever 375 reaches end portion 389 of openings 387, the nickel falls forward out of the chute and the weight on the pawl returns the arm end 397 to upper portion 388 of openings 387. The nickel falls into the escrow box below chute 304.

Figure 21:
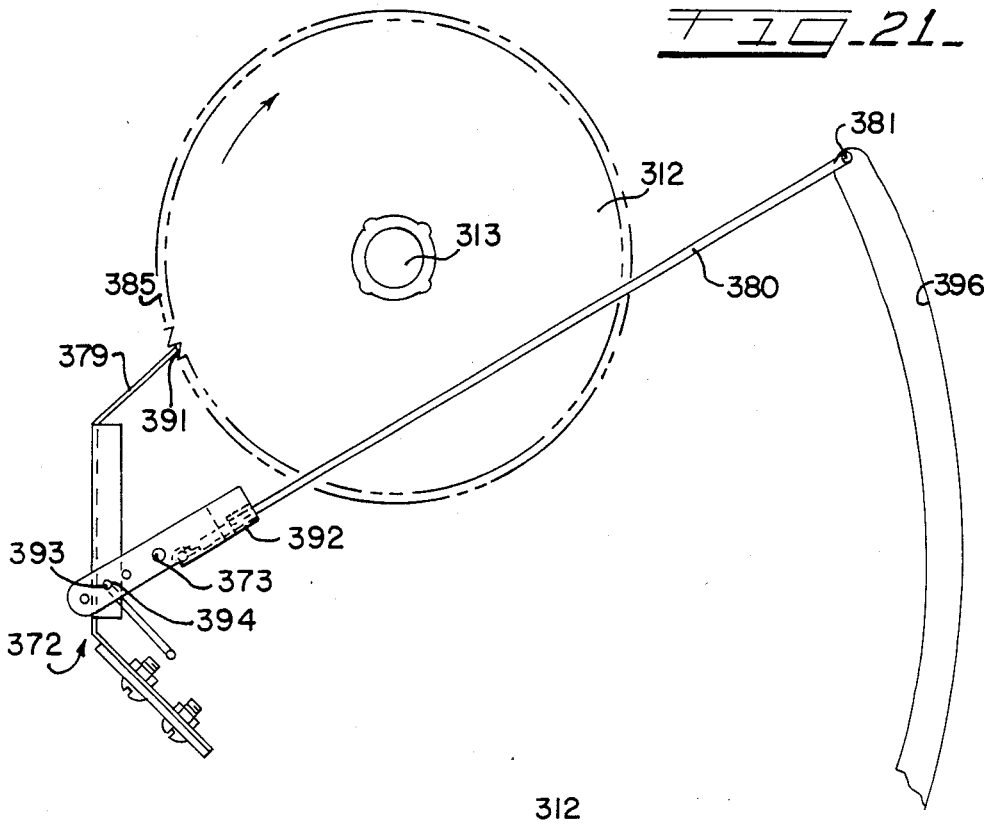
FIG. 21 is an elevation view showing the ten-cent register of the coin mechanism.

FIG. 21 shows pawl and lever assembly 372 in which pawl 379 has a working end 391 contactingly engaged with the periphery 385 of toothed ratchet wheel 312. Pawl 379 is pivotally mounted to a lever body 392 in a second opening 393 by a mounting pin 394. A biasing means, such as a counterweight 395, urges the end 391 of pawl 379 into contacting engagement with periphery 385 of the ratchet wheel. A pair of elongated openings 396 are formed in the walls of dime coin chute 306 and end portion 381 of lever arm 380 extends through and is enabled travel through an arc of 60 degrees.

When a dime is introduced into the top of the chute 306, it contacts end portion 381 and causes it to move downward in the chute through an arc of 60 degrees. Such downward movement causes end 391 of pawl 379 to move upwardly against a tooth and advance the ratchet wheel two teeth clockwise against the urging of constant force spring 363. The dime falls forward out of chute 306 and into the escrow box below. The lever arm is returned to the upper portion of openings 396.

Figure 22:
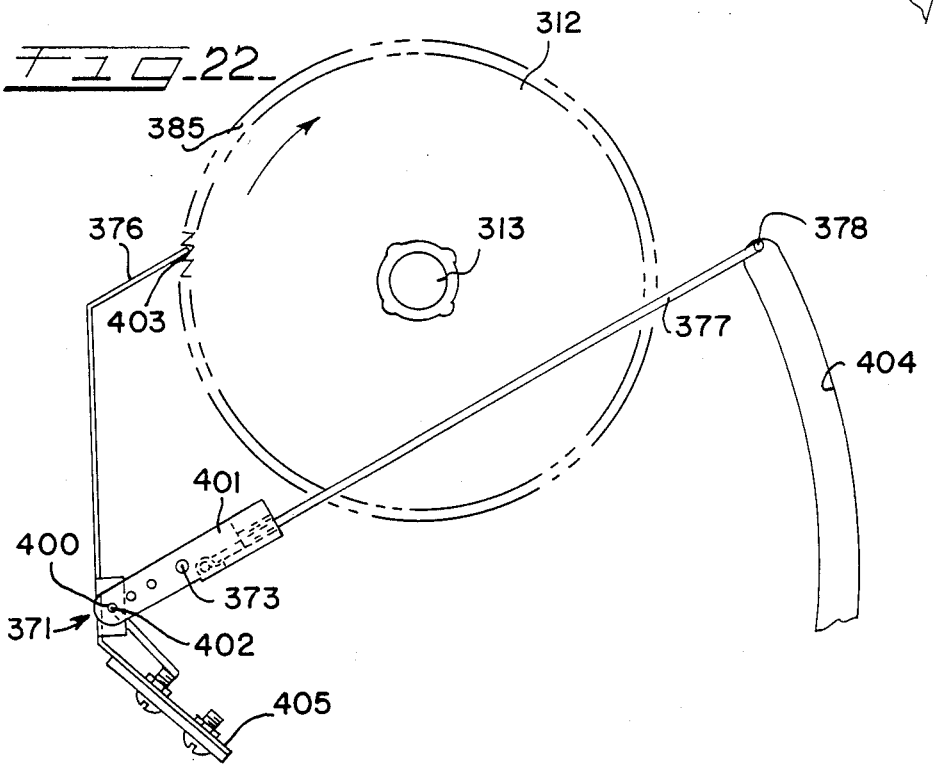
FIG. 22 is an elevation view showing the twenty-five-cent register of the coin mechanism.

FIG. 22 shows pawl and lever assembly 371 used for quarter coin chute 305. Pawl and lever assembly 371 has pawl 376 pivotally engaged with a third opening 400 of a lever body 401 by a pivot pin 402. Pawl 376 has a working end 403 contactingly engaged with the periphery 385 of toothed ratchet wheel 312. The end portion 378 of lever arm 377 extends through a pair of elongated openings 404. As with the nickel and dime coin chutes, lever 377 is enabled 60 degrees of movement through the chute 305. Due to pawl 376 being pivotally engaged with lever body 401 in the third or rearmost opening 400 the working end 403 of pawl 378 contactingly engaged with periphery 385 of toothed wheel 312 advances the wheel five teeth clockwise against the urging of constant force spring 363. A biasing means, such as counterweight 405, urges working end 403 into contact with the teeth on the periphery of the ratchet wheel. The quarter falls forward out of chute 305 when end 378 of arm 377 has traveled to the lower end of openings 404. The quarter falls into the escrow box and the weight 405 on pawl assembly 391 biases end 378 to the upper portion of openings 404.

Figure 23:
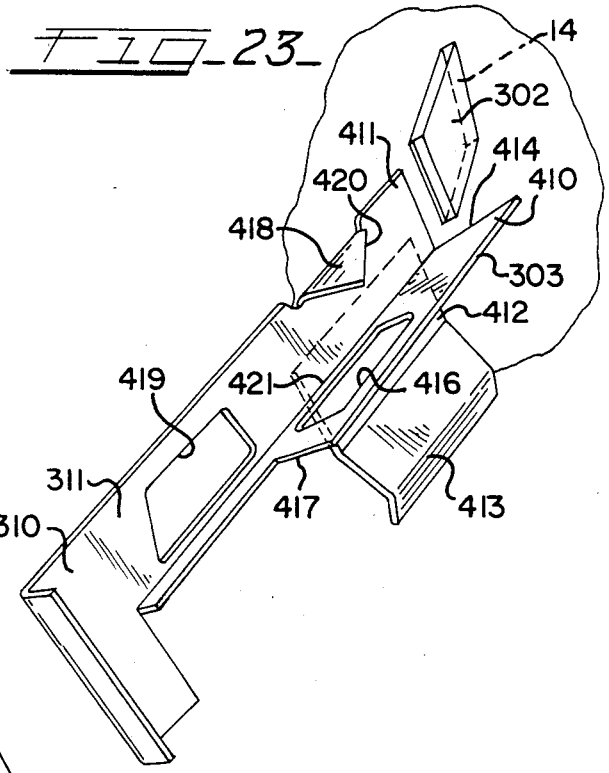
FIG. 23 is a perspective view showing the coin separator trough of the coin mechanism.

FIG. 23 is a perspective view of a coin separator or sorter 303 which receives coins from a coin guide 302 aligned with coin slot 14. Separator 303 is comprised of a V-shaped trough having a first side member or wall 410 and a second side member or wall 411. A mounting means, such as bracket 412, is affixed to trough 303 and has a portion 413 adapted to be affixed to or engaged with the coin mechanism assembly 300.

Coin sorter 303 has a first or upper end portion 414 proximal the coin slot 14 and a second or lower end portion 311 distal the coin slot. Coins deposited through slot 14 are impelled by gravity to travel from upper end 414 toward lower end portion 311.

Wall or side 410 has a first nickel admitting or receiving opening 416 and a second quarter admitting opening or cutout portion 417.

Wall or side 411 has projecting outwardly from it and extending toward wall 410 a coin deflector member 418 and a dime admitting or receiving opening 419. Adjacent the distal end 311 of trough 303 is a penny deflector member 310.

Slot 14 and guide 302 are sufficiently large to admit a largest size coin, such as a quarter, and a plurality of smaller sized coins, such as, in descending order by size, a nickel, a penny, and a dime.

When a quarter is pushed through slot 14, guide 302 causes it to advance downwardly by gravity and travel along wall 411 until its upper portion contacts deflecting surface 420 of deflector projection 418. Surface 420 cams or deflects the upper portion of the quarter progressively outwardly as the gravity impelled quarter, with its lower portion remaining substantially in a straight line of travel at the bottom 421 of the trough formed by the intersection of walls 410 and 411, travels toward end portion 311. Consequently the quarter is tipped to lie closely adjacent wall 410 and slide along it. Nickle opening 416 is sized to be too small to accept a quarter. Therefore, the quarter slides along wall 410 past 416 and falls through cutout or opening 417 and into chute 308, best shown in FIG. 15, to descend downwardly and fall through chute 305, thereby forcing arm 377 through a 60-degree arc to advance ratchet wheel 312 five teeth clockwise rotation.

Similarly, a nickel pushed through slot 14 and guide 302 initially lays adjacent to and travels along wall 411 and its upper portion is cammed outwardly toward wall 410. This outward deflection along surface 420 causes the coin to flop over and travel along wall 410. However, being smaller than the quarter, it is not supported by the portion of wall 410 defining opening 416. Consequently, a nickel will fall through opening 416 and be received in coin chute 306, as best shown in FIG. 15. Chute 307 directs the nickel to enter chute 304 where it causes arm 375 to move through 60 degrees of arc and advance the ratchet wheel one tooth of clockwise rotation.

A penny fed through slot 14 and guide 302 also initially lays against and travels along wall 411. As deflector member 418 is above bottom 421 of trough 303 a distance greater than the diameter of a penny, the penny continues to lay against and travel along wall 411. It passes beneath the deflector and, due to the small size of the opening 419 made to admit or receive dimes, the penny travels over opening 419 and is deflected downward by member 310 to ineffectively fall to the bottom of the coin compartment 13.

A dime, being of a smaller size than a penny, also lays adjacent and travels along wall 411 and pauses beneath deflector member 418. However, the surface of wall 411 defining opening 419 are too far apart to support the dime and it falls through opening 419 into chute 309, as best shown in FIG. 15. Chute 309 guides the dime into coin chute 306 which it falls through. The mass of the dime falling through chute 306 causes the lever 380 to move downwardly through a 60-degree arc causing pawl 379 to advance ratchet wheel 312 two teeth in a clockwise direction.

As disclosed above, the coin separator of this invention discriminates between coins on the basis of the relative diametric size of the coins and directs each coin to an appropriate location where its value is accumulated by advancement of the ratchet wheel and the price setter wheel which advances on shaft 313, together with the ratchet wheel.

Figure 24:
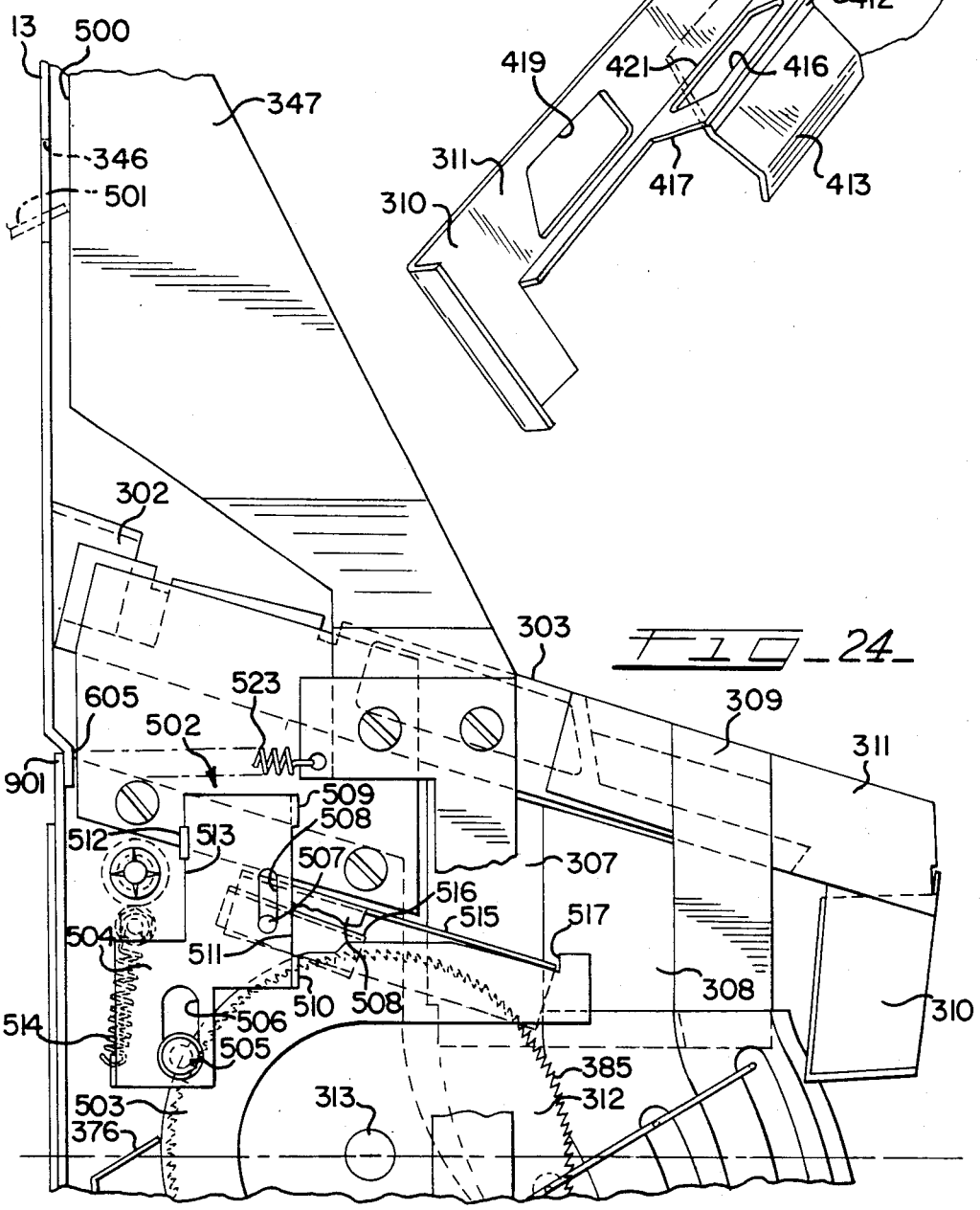
FIG. 24 is an enlarged detail elevation view of the upper half of the coin mechanism shown in FIG. 17.
Figure 25:
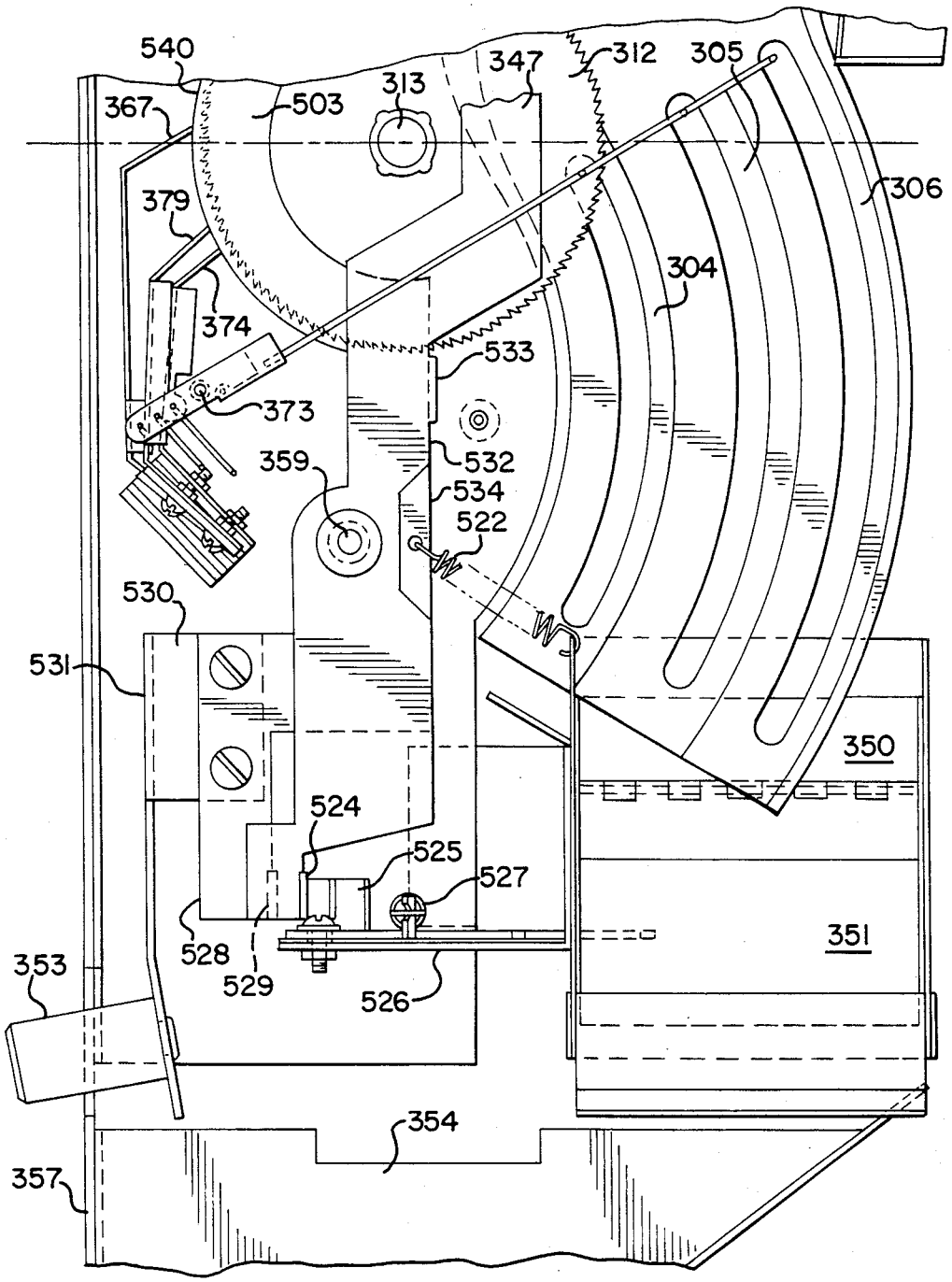
FIG. 25 is an enlarged detail elevation view of the lower half of the coin mechanism shown in FIG. 17.

Referring to FIGS. 24 and 25 in which FIG. 24 shows in enlarged detail the upper portion of coin mechanism assembly 300 in a side elevation view and FIG. 25 shows in enlarged detail the lower portion of coin mechanism assembly 300 in a side elevation view, ejector lever 347 has an upper working edge 500 which is aligned to coact with a door latch flap 501 which is pivotally attached to the operator door and intrudes into the compartment 12 through opening 346 in access door 13.

An anti-cheat mechanism 502 is provided to operate in conjunction with the ejector lever 347, a reset lever 503 and slidable cam member 319.

Mechanism 502 is comprised of a formed plate member 504 slidably mounted to body member 367 by appropriate mounting means, such as fastener member 505 slidably engaged with elongated opening or slot 506. A guide pin 507 slidably engaged with an elongated opening or slot 508 serves to prevent plate member 504 from pivoting about fastener 505.

A pair of laterally extending nibs 509 and 510 are formed on the edge 511 of plate 505 distal the mounting member 501 and a laterally extending nib 512 extends laterally outward from an edge 513 of member 319 proximal to member 301. As best shown in FIG. 17, nib 512 is arranged to contact cam member 319 to be forced downward as member 319 moves downward. A biasing means, such as helical spring 514, as best shown in FIG. 24, resiliently urges the plate member 504 vertically upwardly into contact with cam member 319 via laterally extending nib 512.

Nibs 509 and 510 operatively contact, respectively, an anti-cheat pawl 515 and a totalizer wheel pawl 516 to selectively move the pawls.

Referring to FIG. 25, each reset lever 503 and ejector lever 347 are pivotally engaged with and pivotally movable about pivot member 359. A biasing means, such as helical spring 522, urges lever 503 clockwise about pivot member 359. Also, as shown best in FIG. 24, a biasing means, such as helical spring 523, serves to urge ejector lever 347 counterclockwise about pivot member 359. End portion 358 of lever 347, as shown in FIG. 25, has a laterally extending nib 524 which contacts an upstanding nib 525 on a coin box door control mechanism 526 normally urged closed by a spring 527 to selectively open coin deposit door 351 of coin box 350, thereby causing coins in the box to fall into the bottom of compartment 12.

Similarly, reset lever 503 has a lower end portion 528 having a nib 529 for selectively opening coin return door 352 of coin box 350 (see FIG. 18). Also engaged with end portion 528 of reset lever 503 is an attachment bracket 530 having a connection member 531 to which is engaged coin return member 353.

Affixed to an edge 532 of ejector arm 347 is a laterally extending member or nib 533 which laterally extends sufficiently far to interferingly or contactingly engage a portion of surface 534 of reset arm 503. Member 533 ensures that reset lever or arm 503 is moved counterclockwise on pivot member 359 when ejector lever or arm 347 is moved counterclockwise about pivot member 359, such as when door assembly 200 is opened.

As best shown in FIG. 25, reset lever 503 has an arcuate or semi-circular leading edge 540 having a radius slightly larger than the radius of ratchet wheel 312. Edge 540 is aligned with ratchet wheel 312 whereby as reset lever 503 is pivoted on pivot member 359 it selectively disengages the pawls 374, 376, and 379 from the teeth on the periphery 385 of ratchet wheel 312 when the lever is moved in a counterclockwise direction and it enables the pawls to engage the teeth when the lever is rotated clockwise to position the edge 540 in a position intermediate peripheral edge 385 of the ratchet wheel and the shaft 313.

Figure 26:
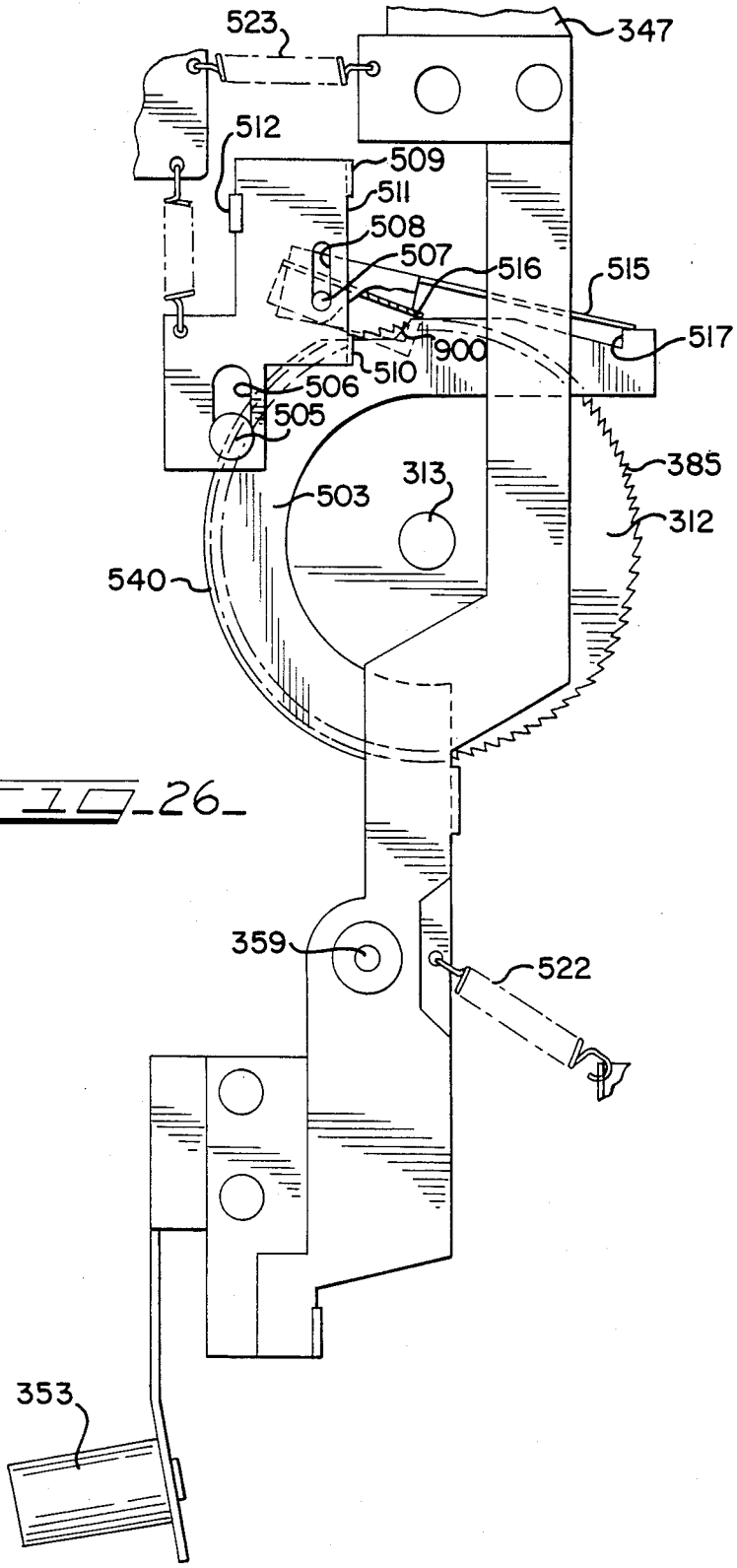
FIG. 26 is a side elevation view of the reset lever of the coin mechanism in the operative position.

FIG. 26 shows the position of the reset lever 503 and the ejector lever 347 in a coin return mode. In this position the holding pawl 516 has been raised out of engagement with the teeth on totalizer wheel 312 by cam portion 900 of reset lever 503 and the leading edge 540 of reset lever 503 has moved to the left beyond the circumference 385 of totalizer body or wheel 312. Edge 540 serves to disengage the drive pawls of assemblies 370, 371 and 372 from the teeth. Pushing coin return button 353 or withdrawing flap 501 to enable lever 347 to pivot toward opening 346, urged by spring 523, causes reset lever 503 to remove all the pawls from the teeth of wheel 312. Wheel 312 is now free to move in a second direction back toward zero, urged by spring 365, until it reaches its zero position. The coin mechanism is thus reset at zero, and upon closing of the operator door, ready for the next vend cycle. Coins in the escrow box would drop into the coin chute and be accessible to the customer.

Figure 27:
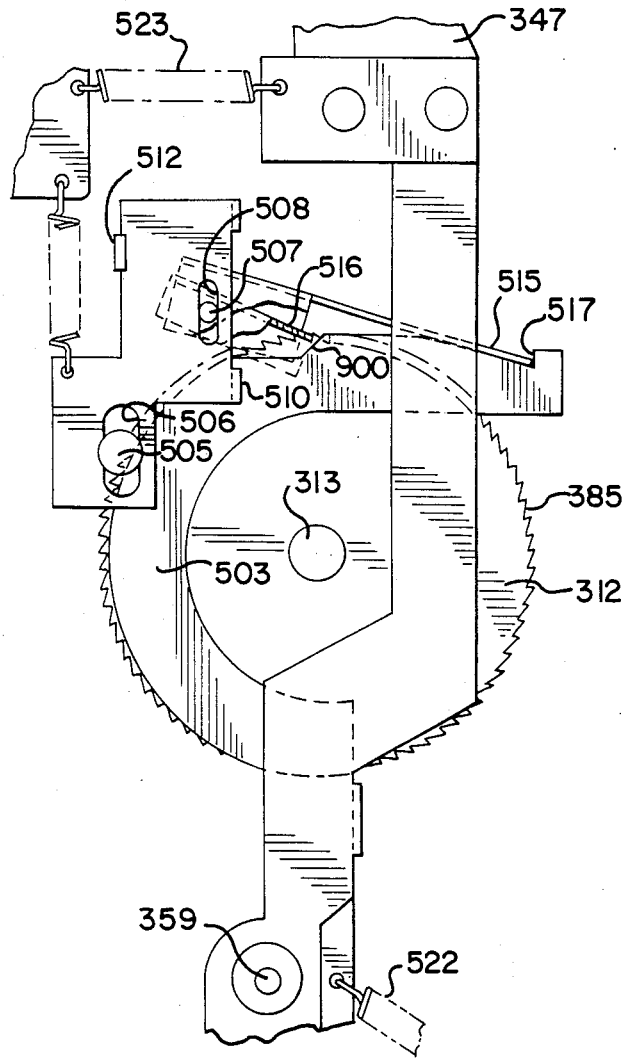
FIG. 27 is a partial view of FIG. 26 showing the reset lever in the inoperative position.

FIG. 27 shows the position of the reset lever 503 and ejector lever in a position in which the reset lever cannot be actuated due to engagement of pawl 515 with stop 517 on the reset lever. In this position totalizer wheel stop pawl is also operatively engaged and prevents the totalizer wheel 312 from resetting to zero. In the position shown, such as when a paper is being dispensed, slide assembly 502 is pushed down a small amount by flap 501 to enable pawl 515 to engage detent 517 and holding pawl 516 remains engaged with the teeth on wheel 312, thus preventing resetting of the wheel and, most importantly, actuation of the coin return button 353 which would enable the customer to simultaneously get his coins back and a paper.

Upon complete opening of the door, the ejector lever is free to move to the left and slide assembly 502 moves upwardly whereby pawl 515 is moved free of detent 517 and pawl 516 is moved upward free of the teeth on the totalizer wheel into substantially the position shown in FIG. 26. Thus, the door can be opened which immediately causes the coins in the escrow box to drop into the bottom of coin compartment 12 and the coin totalizer wheel is reset to its zero position and ready for the next vend cycle.

FIGS. 28 and 29 show in enlarged detail the price setter and price change arrangement of the coin mechanism.

As previously described, cam slide assembly 319 is vertically slidably mounted on door 13 and is upwardly biased by spring 324. Cam member 344 is affixed to slide assembly 319 to slide up and down with it.

A pair of price setter contact surfaces 330 and 331 are provided to contact, respectively, price setter surface 318 of Sunday price setter member 316 and price setter surface 317 of daily price setter member 315. As best shown, a small vertical gap is provided between the price setter members to enable the anti-cheat slide assembly 502 to be moved downwardly as best shown in FIG. 27 when plate 342 contacts nib 512 as shown in FIG. 29.

Daily price member 342 of cam slide 319 is pivotally mounted to the slide assembly by pivot means 343. A push rod 800 is slidably mounted on door 13 by a pair of brackets 801 and 802 and has a spring biasing it to the right into contact with a key operated cam 803. At an opposite end 804, the rod 800 controls a portion of plate 342. When, as shown in FIG. 28, the plate 342 is in the operative position shown in solid lines, surface 331 will contact daily price setter surface 317 of daily price setter 315 when, as shown in dotted line in FIG. 29, the price setter wheel and member 315 have been caused to rotate into an operative position by placement of twenty-five cents in the coin mechanism.

However, as shown in dotted line in FIG. 28, if the cam 803 is turned by appropriate means, such as a key, to the position shown, it cams rod 800 to the left, causing plate 342 to swing out to an inoperative position whereby surface 331 cannot interferingly engage surface 317. When plate 342 is swung out into this inoperative position, then surface 330 can be operatively engaged by surface 318 of Sunday price setter 316, but only when an appropriate amount of coins totaling the Sunday price ($1.30 in the setting of FIG. 29, i.e. 26 holes×5 cents each) has been deposited in the coin mechanism. Then the Sunday price setter, assuming member 316 is properly preset on wheel 314, can be activated by the owner merely turning a key from outside the machine.

FIGS. 30, 31 and 32 show the relationship of the door latch flap mounted on door assembly 200 to the cam member 344 of cam slide 319 and to each the door lock catch 345 and, as shown in phantom in FIGS. 30 and 32, the reset lever 347.

Door latch flap 501 is pivotally mounted on the door by a pin 820 and is urged clockwise by a torque spring 821. Appropriate means, such as stop 822, limit clockwise movement of the flap. Flap 501 has cam surfaces 822 an 823 which coact with cam member 344 of slide assembly 319 and a catch opening 824 which lockingly coacts with surface 825 of catch member 345. Flap 501 also has a leading edge 826 which contacts and, by pushing and holding them inward or enabling them to be biased outward toward opening 346, operates ejector lever 347 and anti-cheat pushrod 129.

When operator door 200 is closed, flap 501 has the relationship shown in FIGS. 31 and 32 with respect to catch 345 and cam 344, and, as shown in FIG. 32, ejector arm 32.

Upon deposit of sufficient coins in the coin mechanism working surfaces, such as price setter surfaces, 331 and 317 will interferingly contact each other, as shown in dotted line in FIG. 29, and cam slide assembly can only travel downward a fixed distance at which time surfaces 331 and 317 will interferingly engage each other and slide assembly 319 and cam member 344 will be prevented from further downward movement. When this happens, as the door 200 is manually pulled open, surface 323 rides up member 344 against the urging of torque spring 821 and cams the flap upwardly to allow edge 827 of opening 824 to clear surface 825 of catch 345. The operator and access door 200 can be completely opened to cause the uppermost newspaper to be dispensed through the dispensing slot.

If a price setter surface 317 or 318 does not engage an appropriate surface 330 or 331 on assembly 319, torque spring 821, being stronger than spring 324, will cause cam 344 and slide assembly 319 to move downward rather than flap 501 being cam upward. Consequently, surface 827 of opening 824 will interferingly engaged surface 825 of catch 345 and the door will be unopenable.

Figure 33:
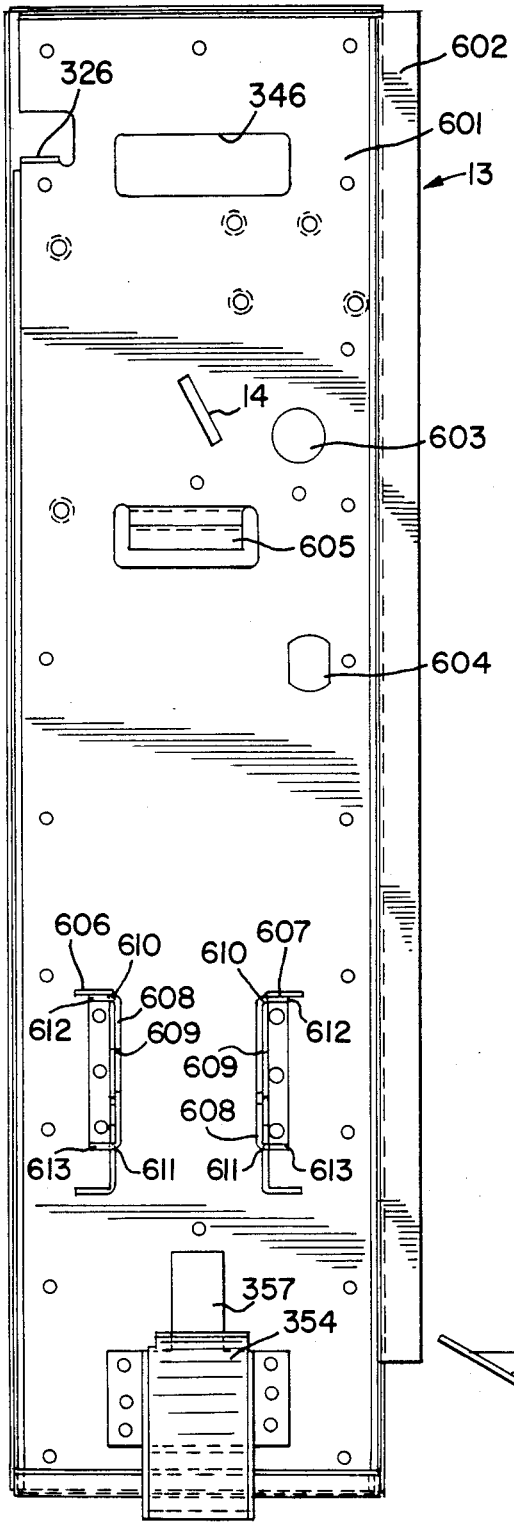
FIG. 33 is a frontal view showing the mounting plate of the coin mechanism shown in FIG. 16.
Figure 34:
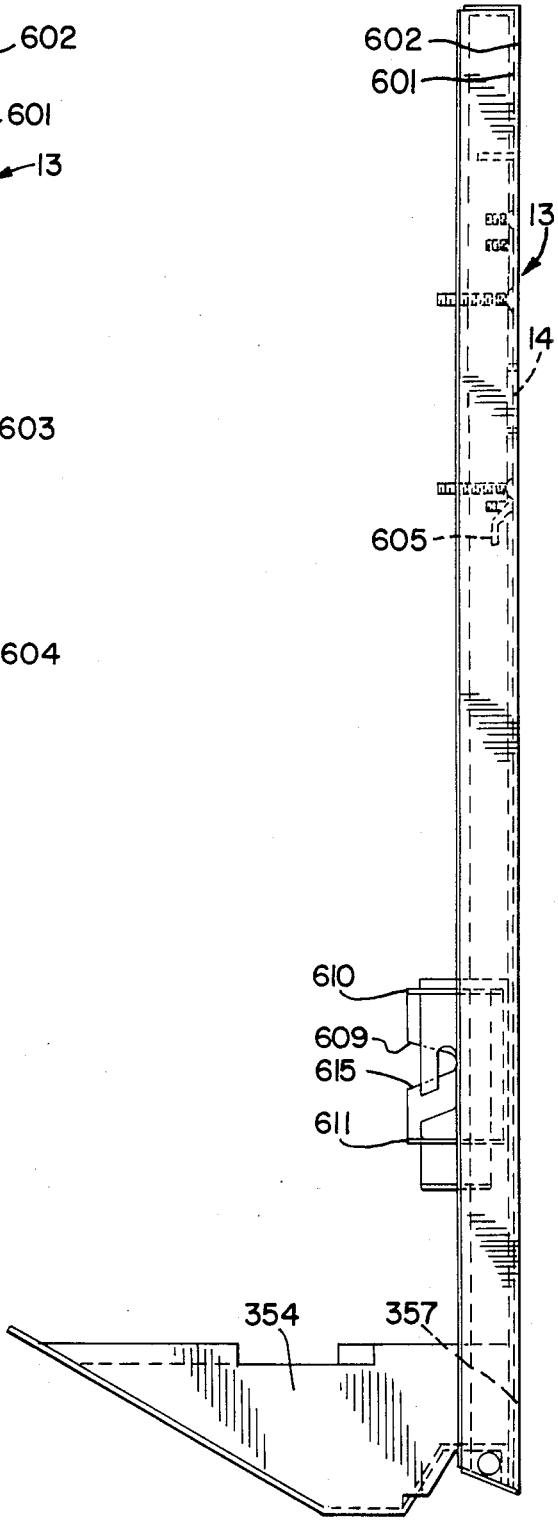
FIG. 34 is a side elevation view of the mounting plate shown in FIG. 33.

FIGS. 33 and 34 show in detail the construction of the mounting means for coin mechanism assembly 300. This construction enables one coin mechanism assembly, such as a unit which is malfunctioning, to be readily removed and replaced by another coin assembly. No tools are required for the substitution. Access door and mounting assembly 13 is comprised of an inner mounting plate 601 and an outer cover, such as metal cover 602. Extending through each the cover and the mounting plate are latch flap opening 346, coin slot opening 14, coin return access opening 357 and a first lock assembly opening 603 and a second lock assembly opening 604.

First lock assembly opening 603 is for receiving a key operated lock assembly for locking access door 13 to the cabinet of machine to prevent unauthorized access to coin compartment 12. Second lock assembly opening 604 is for receiving a key lock assembly for selectively changing the coin mechanism assembly mounted on the door 13 to be responsive to an alternate price, such as, for example, to either a daily or Sunday price setting.

A catch means, such as catch member 605, extends inwardly and downwardly to entrap a compatibly configured bar like member 901 in the body portion of the coin mechanism assembly 300.

A first and second retainer bracket assembly 606 and 607 is provided. Each retainer bracket assembly is comprised of a fixed bracket member 608 affixed, as by spot welding, to plate 601. Each of the fixed bracket member 608 has an attachment pin receiving opening 609 and a bracket receiving opening 610 and 611 at each of two ends 612 an 613. A retainer bracket 614 is slidably mounted in openings 610 and 611 of each of the fixed bracket members 608. Each movable retainer bracket 614 has an entrapment opening 615 whereby when a bracket 614 is moved vertically upward with respect to the fixed bracket 608, a pin may be slid into or out of the aligned openings 609 and 615. When the movable bracket 608 is slid downwardly, such as by gravity or manually, with respect to the fixed bracket 608, the opening 609 and 615 are misaligned to enable entrapment of a mounting pin in each of the bracket assemblies 606 and 607.

Mounting pin means adapted to fit into openings 609 and 615 of each bracket 606 and 607 are affixed to coin mechanism assembly 300, as shown for mounting pin 92 in FIG. 17.

Figures 35, 36:
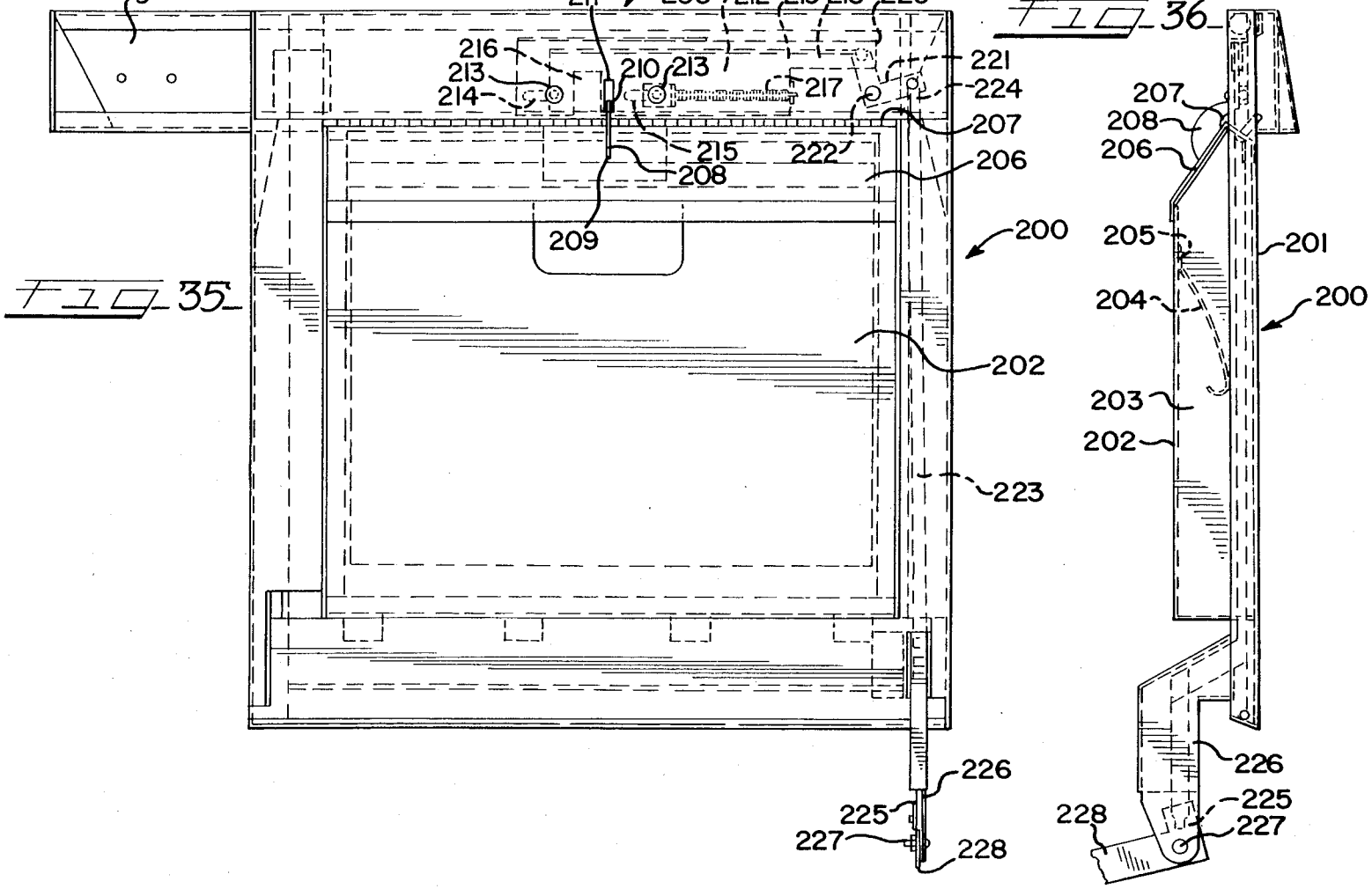
FIG. 35 is a frontal view showing the inner face of the operator door assembly of the machine.
FIG. 36 is a right side elevation view of FIG. 35.

FIGS. 35 and 36 show, respectively, a front elevation view and a right side elevation view of operator door assembly 200. Assembly 200 is formed of a front panel 201 and a rear panel 202 connected together to form a space between the panels. A portion of this space is comprised of a display paper compartment 203 having transparent enclosure 11 at its front portion. A biasing means, such as formed flat spring 204 attached to a rear wall portion 205 of compartment 203 serves to urge a paper placed in the compartment against the inside surface of number 11 to enable a prospective customer to clearly view the paper from the front of the machine.

At the upper inside portion of assembly 200 is a display paper access door 206 pivotally mounted to the interior of the door by a hinge 207. Hinge 207 has a biasing means, such as well-known torque springs (not shown) wrapped around the hinge pin, to resiliently urge door 206 open. Mounted on door 206 is a latch member 208 having an end 209 attached to door 206 and a latching end 210 engaged with an opening 211 in the inner portion of the door. A locking plate 212 is slidably attached to the door panel by appropriate means, such as, as shown, a pair of rivets 213 which are each engaged with an elongated slot 214 and 215. Locking plate 212 in its normal condition covers opening 211 to prevent end 210 of latch number 208 from traveling further through the opening to enable the door, urged open by the torque spring on the hinge pin, to open.

A notch or opening 216 is provided in plate 212. When this notch 216 is aligned with opening 211 in the door the end 210 of latch member is free to travel into opening 211 and the door 206 is urged opened by the torque spring to provide a customer access to a paper contained in the display compartment of the door.

Locking plate 212 is normally urged, such as by a helical spring 217 to a notch misaligned position with respect to opening 211 whereby door 206 remains closed.

A lateral linkage member 218 is connected at a first end 219 to locking plate 212 to force the notch in the plate into alignment with opening 211. A second end 220 of linkage member 218 is connected to a pivotally mounted bell crank 221 which is mounted to door 200 by a pivot pin 222.

A vertically extending linkage 223 has a first end 224 engaged with bell crank 221 and a second or lower end engaged with a bell crank 225 which is pivotally mounted to a support bracket 226 affixed to the inner or rear panel 202 of assembly 200. A pivot pin 227 pivotally engages bell crank 225 to bracket 226. A trip bar 228 is rigidly affixed to an end of the bell crank 225 and extends into the enclosure of the machine.

Figure 37:
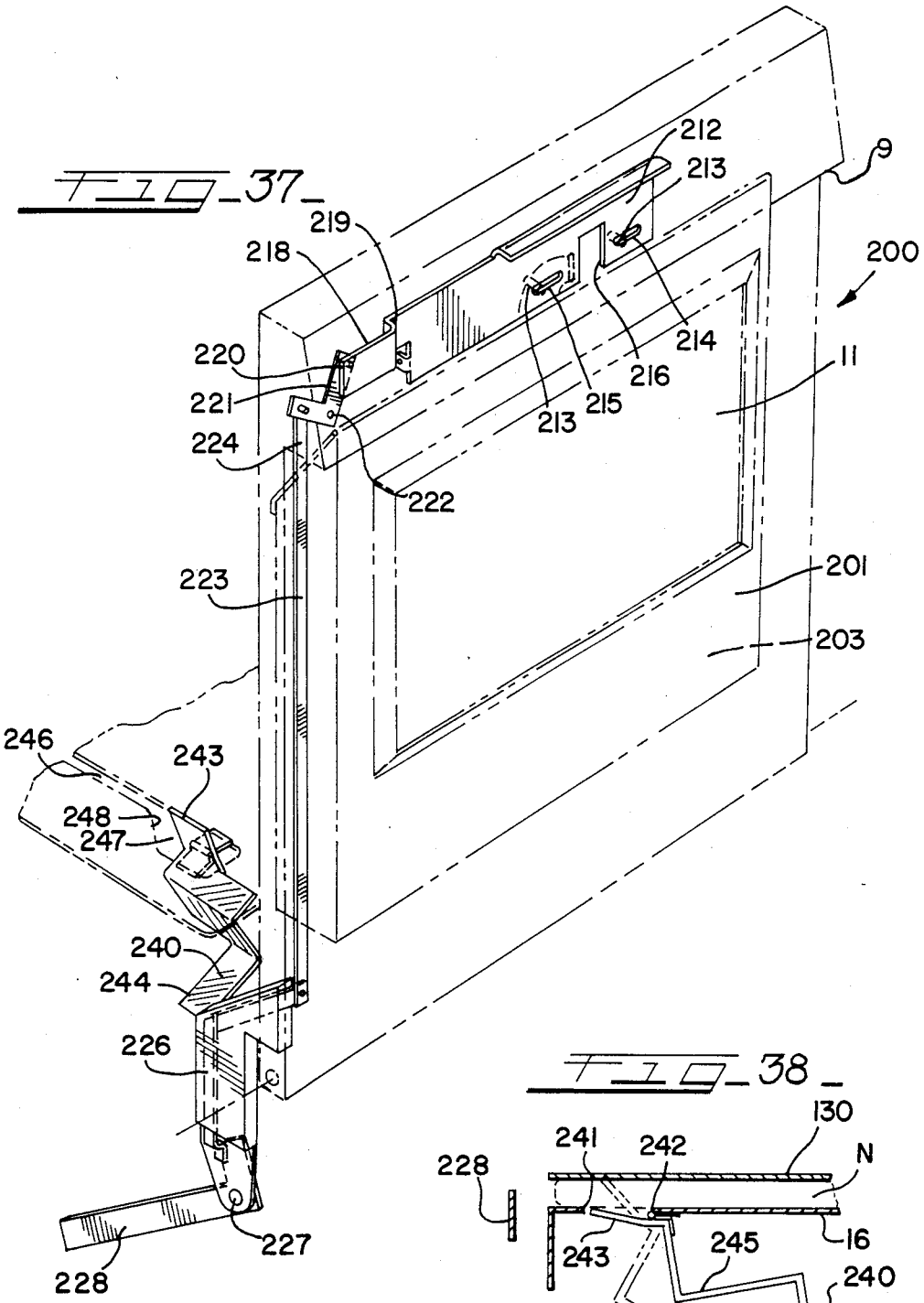
FIG. 37 is a perspective view showing the structure of the display paper dispensing mechanism from the display paper compartment of the operator door, which is shown closed in phantom.
Figures 39, 40:
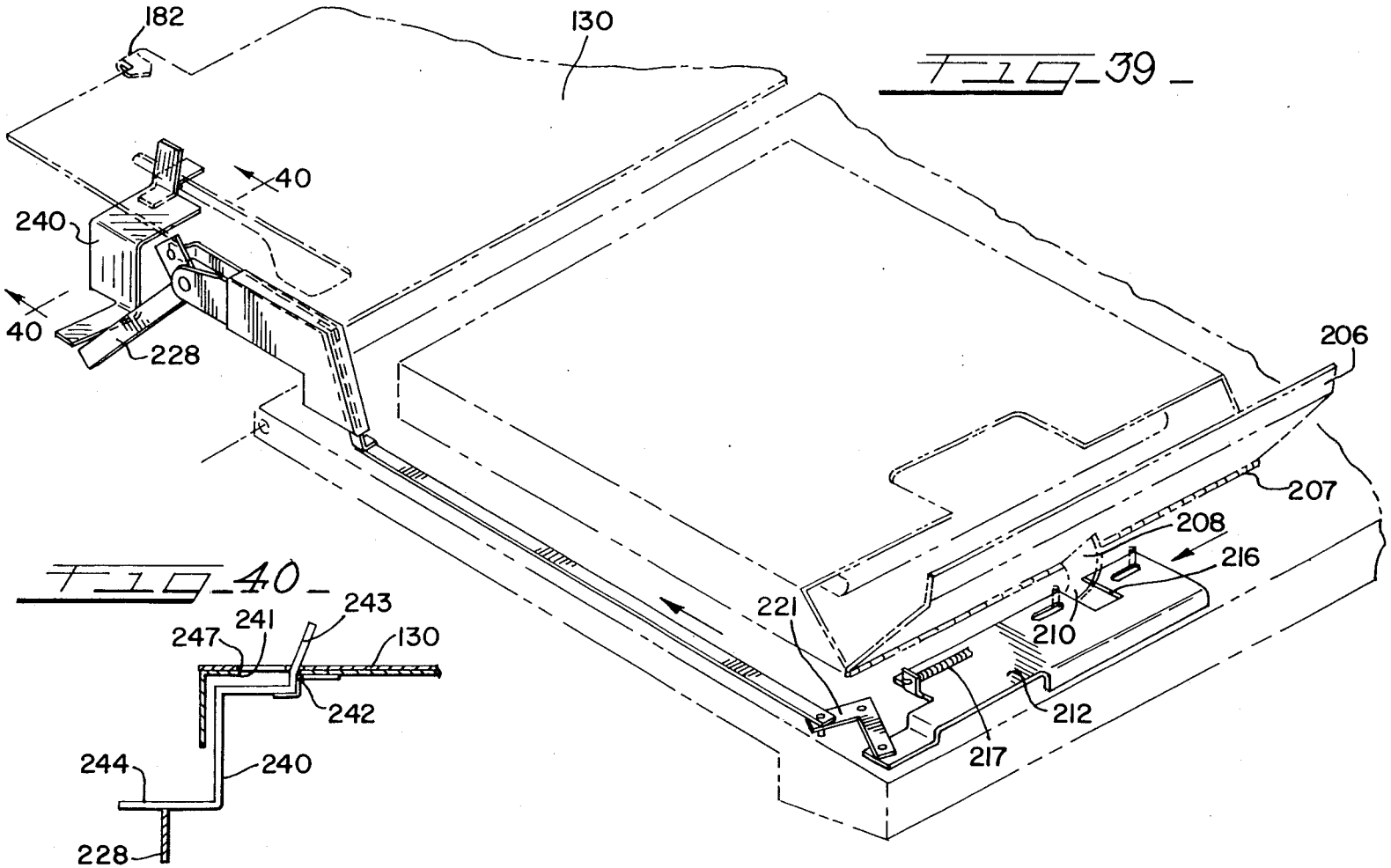
FIG. 39 is a perspective view of the display paper dispensing mechanism of the operator door, which is shown opened in phantom.
FIG. 40 is a view of the display paper trip actuator shown in FIG. 38 in which the actuator is shown cammed into operative position.

As shown in perspective in FIGS. 37 and 39, a trip bar actuator 240 is pivotally engaged with an opening 241 in support platform 16. A pivot pin 242 maintains the actuator 240 pivotally mounted to the platform. Actuator member 240 has a cam nib portion 243 and a trip bar interfering nib 244. Nibs 243 and 244 are connected together by an actuator body portion 245.

Figure 38:
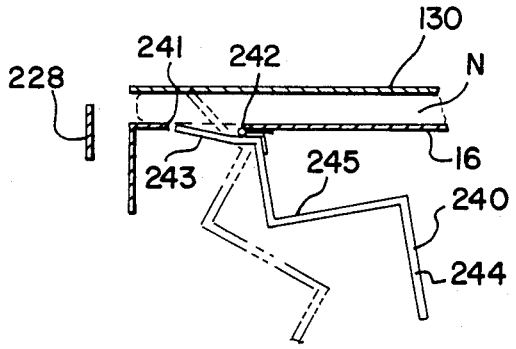
FIG. 38 is an enlarged detail view of the display paper trip actuator mounted on the support platform.

Cam nib 244 of the actuator member normally lays even with or beneath the surface of the newspaper support platform in opening 241 and the trip arm interfering nib is thus maintained swing up beneath the platform by the presence of a newspaper N covering opening 241, as shown in FIG. 38.

Figure 43:
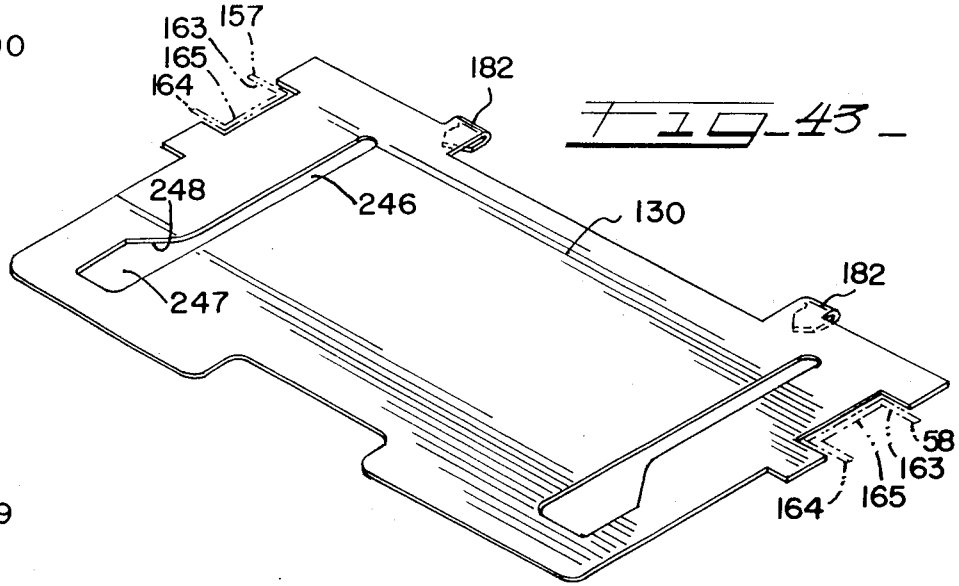
FIG. 43 is a perspective view showing the paper pick-up member of the machine.

The paper pick up member 130 has, as shown in phantom lines in FIG. 37 and better shown in FIG. 43, a cam slot 246 having an enlarged portion 247 alignable with opening 241 in the platform and an inwardly curving cam surface 248.

When the last paper on the support platform has been dispensed from the machine and the dispensing carriage and pick-up member 130 are returned to their normal positions as shown in FIG. 37, the actuator member, impelled by the mass of its eccentrically mounted body on and pivot pin 242, swings downwardly, as shown in phantom lines in FIG. 38, causing cam nib 243 to project into opening or enlarged portion 247 of slot 246. Upon commencement of the next vend cycle as the paper pick-up member is moved forward with the dispensing carriage, the cam nib is engaged by cam surface 248 of slot 246. As the paper pick-up member continues to move forward, the cam nib is forced to move inwardly along surface 248 causing the actuator member to swing clockwise as pivot pin 242 until interfering nib 244 is swung completely out from beneath the platform side to the position shown in FIGS. 39 and 40 and be aligned to interferingly engage a top portion of the trip bar and prevent it from swinging with the operator door. When the trip actuator member engages the trip bar as the door is swung to the open position, bell crank 228 is forced to pivot with respect to the mounting bracket 226. This causes bell crank 221 to pivot counterclockwise forcing slide plate 212 to the left against the urging of spring 217. As the door 200 continues to be swung open, the slide plate is moved sufficiently far to the left to align slot 216 with slot 211 to enable end 210 of latch member 208 to enter into the interior of the door. Upon alignment the torque spring automatically urges the latch 208 into the aligned slots and door 206 opens whereby the customer can reach into the compartment and manually remove the display paper.

Operation of machine 2 is as follows. The machine attendant opens door 200, using a key or coins, and removes any previous papers by unlocking key cam 115 to separate the upper and lower shutter assemblies and slidably moving the upper shutter assembly up as far as possible and the lower shutter assembly down as far as possible. He now has access to pick-up member 130, platform 16 and any papers on it. By raising and tilting member 130 laterally, it is freed from channel bars 157 and 158 and removed from the machine. The old papers are then removed from platform 16 and replaced with a stack of new papers. The display paper trip actuator 240 will automatically be biased to its inoperative position as the papers are placed on the platform. The member 130 is then re-engaged with channel bars 157 and 158 and falls downwardly to operatively engage the uppermost paper with members 182 positioned rearwardly of the unfolded back edge of the uppermost paper.

The upper and lower shutter assemblies are then manually slidably moved toward each other. As alignment member 127 will contact the top surface of member 130, the lower shutter assembly will be pulled upwardly and the key cam of lock 115 will be locked to engage nibs 73 and 74 with detents 59 and 60 to define the automatic height self-adjusting dispensing slot covered by flaps 91 and 93.

Coin compartment access door 13 may then be unlocked, a conventional key lock being used, and opened and any coins removed from the bottom of compartment 12. Access door 13 is then closed and relocked, and door assembly 200 is allowed to close by the urging of spring 715 (FIG. 9). Latch flap 601 will lockingly engage latch member 345 (FIG. 31), and the machine is ready for a normal vend cycle.

To initiate the vend cycle, the customer deposits in slot 14 the requisite value of coinage. Each coin enters sorter 303 (FIG. 23), preferably through quide means such as guide sleeve 320, and is directed to the appropriate coin chute of the coin mechanism assembly 300. Each coin causes the totalizer body or wheel 312 to rotate against the urging of the constant rate spring an amount of teeth equal to the value of the coin in cents divided by 5. When the correct amount of coinage corresponding to the predetermined setting of a price setter memeber on wheel 314, which rotates on the same shaft with totalizer wheel 312, has been deposited, the price setter will be in position to interferingly engage an appropriate surface on cam slide assembly 319.

As the customer manually pulls the door open, flap 501 will cam member 344 and slide assembly downwardly to (1) prevent the coin return from being simultaneously actuated, and (2) to engage an appropriate surface on slide assembly 319 with the correctly position price setter surface (FIGS. 28 and 29). Interfering engagement of these surfaces prevents continued downward movement of cam 344 and slide assembly 319. Consequently, latch flap 501 is cammed upwardly against the urging of torque spring 821 by cam 344. Upward pivotal movement of flap 501 causes clearance of surface 825 of catch member 345 (FIG. 31) and the door is openable.

Continued manual opening of the door causes linkage 174 to actuate dispensing carriage assembly 150 and as members 168 and 169 force channel bars 157 and 158 forward (FIGS. 5 and 6), hooks 182 of member 130 movingly engage the rear unfolded edge of the top paper and impel it forward as it slides over the paper beneath it. The folded leading edge of the paper contacts inner flap 93 and causes it to pivot downward toward an open position. As the paper continues outward, it contacts and causes flap 91 to pivot downward. This pivotal downward movement of flap 91 immediately releases pawl assemblies 97 and 98 into engagement with ratchets 95 and 96, respectively, on inner flap 93 (FIGS. 13 through 16). Engagement of the pawls with the ratchets prevents additional pivotal opening movement of flap 93 and thus automatically causes the dispensing slot or opening to be substantially self-adjusting in vertical height to the thickness of the paper being dispensed. This automatic self-adjusting feature precludes the need for the attendant to manually adjust the opening.

Upon full opening of the operator door 200, a graspable portion of this dispensed paper will be accessible to the customer, and no other papers will be accessible to the customer as flap 93 cannot be opened further while flap 91 is open. Upon manual withdrawal of the dispensed paper through the dispensing slot, the customer releases door assembly 200, and spring 715 urges the door to a closed and locked position.

As flap 501 was withdrawn through opening 346 in access door 13 of compartment 12, reset lever was allowed to advance toward opening 346 as the upper portion was urged to pivot toward the opening about pivot member 359 by the urging of spring 523. Due to the tab 533 contacting reset arm 503, pawls 367, 374 and 379 and control pawl 516 were cammed out of engagement with the teeth of totalizer wheel 312 as the ejector lever pivoted toward opening 346. This allowed the totalizer wheel and price setter wheel to return to the zero position by the urging of the constant rate spring. Simultaneously, tab 524 on the lower portion of ejector lever 347 caused the flap 351 of the escrow box 350 to open and empty the deposited coins into the bottom portion of compartment 12.

As the door is urged closed by spring 715, leading edge 826 of flap 501 contacts the upper portion of ejector lever 347 and causes it to pivot away from open 346 about pivot member 359. This causes the reset arm 503 to pivot to a position where the drive pawls 367, 374 and 379 and the holding pawl 516 are once again engaged with the teeth on totalizer wheel 312.

Flap 501 also again lockingly engages latch member 345. Edge 826 of flap 501 also pushes pushrod 129 rearward to cause crank plate 132 to rotate clockwise. Clockwise movement of crank 132 causes pawl 138 to be moved downward with crank portion 137 to cause pawl 138 to clear detaining bracket 142. Upon substantially complete closing of the door, the carriage return spring 180 (FIG. 7) attached to pull back eccentric 166' continues to pull the members 168 and 169 and 157 and 158 operatively engaged with them to their rearmost position in which members 182 of member 130, which drop downwardly with respect to channel bars 157 and 158 to lie on the now uppermost paper, slide off the back edge of the top paper and are again rearward of the unfolded edge and in a position to engage that edge and slide that paper forward on to the next vend cycle.

Pick-up members, such as pick-up member 130, may be provided with a second set of paper engagement hooks or members 182 which extend in a direction opposite the first set. The second set would extend further away from the body portion of member 130. Thus, member 130 can be positioned on one side to have lesser downwardly extending hooks used to contact and impel relatively thin daily papers. It can also be rotated 180 degrees and placed in the machine with the greater downwardly extending hooks positioned to contact and impel relatively thick Sunday papers. Alternatively, a plurality of members 130 having hooks covering a range of extension may be provided to be matched to papers of various thicknesses.

What is claimed is:

1. A machine for vending an article one at a time, said machine comprising, in combination:

means for enclosing articles for maintaining a plurality of articles in a protected location, said enclosing means, having an opening;

means for closing said opening and said enclosing means, said closing means having an article dispensing opening;

means for automatically limiting the vertical height of said article dispensing openings to a height substantially equal to the thickness of an article being dispensed comprising a pair of flaps covering said dispensing opening and adapted to be opened by the leading edge of said one uppermost article being dispensed through said opening;

said pair of flaps comprising an inner flap and an outer flap, and opening limiting means for said flaps whereby said inner flap only opens an amount substantially equal to the thickness of the article being dispensed;

said opening limiting means comprising a pawl engaged by said outer flap and operatively connected to a ratchet means engaged with said inner flap for limiting the extent of the opening of said dispensing opening to substantially the thickness of the article being dispensed;

an operator door openable and closable with respect to said enclosing means, said operator door substantially covering said closing means when said door is closed and exposing said article dispensing opening when said door is open;

means for dispensing an article enclosed within said enclosing means, and means for operatively connecting said operator door with said dispensing means whereby as said operator door is moved from a closed to an open position with respect to said enclosing means, one of said articles is at least partially dispensed through said article dispensing opening in said closing means.

2. The invention defined in claim 1 together with means for locking said operator door in a closed position.

3. The invention defined in claim 2 together with a coin accumulator mechanism within said enclosing means for enabling unlocking of said locking means on said operator door upon deposit in said coin accumulator mechanism of a predetermined amount of coinage.

4. The invention defined in claim 1 in which said means for enclosing a plurality of articles is a cabinet having a platform for supporting a plurality of newspapers stacked on top of each other.

5. The invention defined in claim 4 in which said dispensing means is an article pick-up member engaged to a dispensing carriage and said dispensing carriage is operatively connected to said operator door.

6. The invention defined in claim 5 in which said article pick-up member has hook-like article engagement means for engaging an edge of one uppermost article on said supporting platform whereby as said operator door is moved from a closed to an open position said dispensing carriage operatively connected to said operator door is caused to move toward said dispensing opening in said closing means and an article engaged by said hook-like means on said article pick-up member engaged by said dispensing carriage is thereby forced at least partially through said dispensing opening for being accessible for being manually removed from said machine.

7. The invention defined in claim 6 in which said article is a newspaper and an unfolded edge of said newspaper is engaged by said hook-like means and a folded edge of said newspaper is forced through said dispensing opening.

8. The invention defined in claim 1 in which said closing means is slidably engaged with said enclosing means for enabling said dispensing opening to move up and down with respect to said enclosing means.

9. The invention defined in claim 8 in which said closing means is comprised of an upper member and a lower member and said dispensing opening is substantially a horizontal slot formed between said upper member and said lower member and said slot is slidable up and down with respect to said enclosing means.

10. The invention defined in claim 9 in which said means for maintaining a plurality of articles is an article support platform slidable up and down with respect to said enclosing means.

11. The invention defined in claim 10 together with resilient biasing means for resiliently urging said article support platform upward.

12. The invention defined in claim 11 together with alignment means operatively connecting said closing means and said support platform for maintaining said dispensing opening in a desired position with respect to said platform.

13. The invention defined in claim 12 in which said support platform is adapted for supporting a plurality of newspapers stacked one on top of the other and a paper pick-up member is engaged with said uppermost newspaper on said stack and said alignment means is affixed to said closing means and engages said paper pick-up member for maintaining the uppermost newspaper on said stack aligned with said slot.

14. A machine for dispensing a single copy of a newspaper upon deposit of a predetermined amount of coinage in a coin receiving and totalizing mechanism of said machine, said machine comprising, in combination:

means for enclosing a plurality of newspapers stacked one on top of another, said enclosing means having a newspaper support platform having a rear portion and a front portion, said support platform being slidably movable up and down within said enclosing means and resiliently biased toward an upper portion of said enclosing means;

a dispensing carriage arranged for traversing said newspaper support platform from said rear portion of said platform toward said front portion of said platform, said carriage having a newspaper contacting and moving member having a newspaper engaging means for engaging a portion of an edge of an uppermost newspaper supported by said support platform, said newspaper contacting and moving member being engaged for horizontal movement with said dispensing carriage and for vertical movement with respect to said dispensing carriage;

an opening in a front portion of said enclosure, said opening being adjacent to said front portion of said support platform;

means for closing said opening, said closing means being slidably mounted to said enclosure for being slidably movable up and down with respect to said enclosure, said closing means having a substantially horizontally extending newspaper dispensing slot extending through said closure means;

a pair of flaps covering said newspaper dispensing slot and adapted to be opened by the leading edge of an uppermost article being dispensed therethrough;

said pair of flaps comprising an inner flap and an outer flap, an opening limiting means for said flaps whereby said inner flap opens an amount substantially equal to the thickness of the article being dispensed through said dispensing slot;

said opening limiting means comprising a pawl operatively connected to one of said flaps and to a ratchet means in contact with the other of said flaps with said pawl and ratchet means operatively engaged so as to limit the extent of the opening of said newspaper dispensing opening to substantially the thickness of the article being dispensed;

and means for aligning said dispensing slot and said newspaper contacting and moving means for maintaining an uppermost newspaper supported on said support platform aligned with said dispensing slot for enabling a portion of said upper newspaper to be pushed into said dispensing slot by said paper contacting and moving means as said dispensing carriage is caused to traverse said support platform from said rear portion to said front portion.

15. The invention as defined in claim 14 together with an operator door pivotally hinged to said enclosing means, said operator door having a closed position and an open position and means for operatively connecting said operator door to said dispensing carriage whereby as said operator door is moved from said closed position to said open position said dispensing carriage and said paper contacting and moving member are caused to traverse said support platform.

16. The invention as defined in claim 15 in which said operatively connecting means is a linkage member pivotally engaged with a portion of said operator door and pivotally engaged with a portion of said dispensing carriage.

17. The invention as defined in claim 16 together with a coin totalizer mechanism within said enclosing means and a locking means engaged with said door and said mechanism whereby upon deposit of a predetermined amount of coins in said mechanism said locking means enables said door to be moved from said closed to said open position.

18. The invention as defined in claim 14 in which paper contacting and moving member is engaged with said dispensing platform whereby said member is forced to move horizontally with said dispensing carriage and is free to move vertically up and down with respect to said dispensing carriage.

19. The invention as defined in claim 18 in which said newspaper engaging means is a pair of hook-like members engaged with and downwardly depending from a rear portion of said paper contacting and moving member.

20. The invention as defined in claim 19 in which said hook-like members are configured to engage a rear edge portion of an uppermost newspaper on said support platform and force at least a portion of said newspaper to move into said dispensing slot as said dispensing carriage moves from said rear portion of said platform to said front portion.

21. The invention as defined in claim 20 in which said hook-like members are configured to slide over an uppermost newspaper as said dispensing carriage moves from said front portion to said rear portion of said support platform.

* * * * *